US005735108A

United States Patent [19]

Tuji

[11] Patent Number: 5,735,108

[45] Date of Patent: Apr. 7, 1998

[54] SHEET BUNDLING APPARATUS AND A SHEET HANDLING APPARATUS FURNISHED WITH THE SAME

[75] Inventor: Iwao Tuji, Tokyo, Japan

[73] Assignee: Kabushiki Kaisha Toshiba, Kawasaki, Japan

[21] Appl. No.: 735,548

[22] Filed: Oct. 22, 1996

[30] Foreign Application Priority Data

Oct. 23, 1995 [JP] Japan ..... 7-274360

[51] Int. Cl.[6] ..... B65B 35/50; B65B 27/08

[52] U.S. Cl. ..... 53/540; 53/168; 53/389.3; 53/586; 53/590; 270/58.08; 270/58.11

[58] Field of Search ..... 270/58.08, 58.11; 53/168, 202, 389.2, 389.3, 540, 117, 586, 588, 589, 590

[56] References Cited

U.S. PATENT DOCUMENTS

| | | | |
|---|---|---|---|
| 4,020,616 | 5/1977 | Nakajima et al. | 53/540 X |
| 4,111,116 | 9/1978 | Ito et al. | 53/586 X |
| 4,126,982 | 11/1978 | Ito et al. . | |
| 4,250,692 | 2/1981 | Uchida | 53/586 X |
| 4,276,736 | 7/1981 | Haberstroh et al. | 53/540 X |
| 4,406,728 | 9/1983 | Ohba et al. | 53/588 X |
| 4,424,660 | 1/1984 | Sato et al. | 53/540 |
| 4,492,072 | 1/1985 | Miyano et al. | 53/588 X |
| 4,531,344 | 7/1985 | Sato et al. | 53/540 X |
| 4,627,218 | 12/1986 | Akerstrom et al. . | |
| 4,683,708 | 8/1987 | Linder | 53/168 X |
| 4,817,804 | 4/1989 | Kawano et al. | 53/588 X |
| 5,126,002 | 6/1992 | Iwata et al. | 53/540 X |

FOREIGN PATENT DOCUMENTS

| | | |
|---|---|---|
| 0 238 450 | 9/1987 | European Pat. Off. . |
| 2 027 666 | 2/1980 | United Kingdom . |

*Primary Examiner*—Daniel Moon

*Attorney, Agent, or Firm*—Cushman Darby & Cushman IP Group of Pillsbury Madison & Sutro LLP

[57] ABSTRACT

A handling apparatus has a bundling apparatus, which stacks and bundles each predetermined number of securities from which information is detected by a discriminating section. The bundling apparatus includes a stacking plate for stacking the securities thereon and a rotatable sweeper for moving the stacked securities together with the stacking plate in a manner such that the securities are held between the sweeper and the plate. In a bundling position, a bunch of securities held on the stacking position is curved by a curving device, and is then wound and bundled with a band by of a bundling mechanism.

20 Claims, 33 Drawing Sheets

SHEET BUNDLING APPARATUS AND A SHEET HANDLING APPARATUS FURNISHED WITH THE SAME

BACKGROUND OF THE INVENTION

1. Field of the Invention

The present invention relates to a sheet bundling apparatus for bundling each predetermined number of sheets, such as securities, with a band and a sheet handling apparatus furnished with the bundling apparatus.

2. Description of the Related Art

A sheet handling apparatus for handling sheets, such as securities, comprises a supply section in which a large number of securities are stacked in layers, a transportation device for transporting the securities, picked up one after another from the supply section, to a sorting section along a fixed transportation path, and a bundling apparatus for bundling each predetermined number of sorted securities.

In general, a bundling apparatus comprises a bundling section located at a given distance from a stacking section, which carries thereon a bunch formed of a predetermined number of securities stacked in layers, and a bunch transportation carrier that receives the bunch of securities from the stacking section and transports it to the bundling section. The carrier includes a bunch keeper mechanism for clamping the bunch being transported.

The bundling apparatus winds a band around the bunch as the bunch is transported from the stacking section to the bundling section by means of the bunch transportation carrier. In the bundling section, the band is strained, cut, and then fastened by thermocompression bonding.

In the conventional bundling apparatus described above, however, the bundling section is situated at a parallel distance of about 300 mm from the stacking section, so that the bunch transportation carrier must move for about 600 mm both ways in each cycle of bundling operation. Accordingly, this movement process entails a substantial extension of the entire cycle time, thus lowering the handling efficiency.

In the movement process described above, moreover, although the bunch transportation carrier clamps the bunch of sheets by means of its bunch keeper mechanism as it transports the bunch, some sheets may possibly fall during the transportation, depending on their stacking state and material. If any of the sheets fall, count information for the sheets counted before the bundling operation will become erroneous. In order to avoid such an error in the count information, the sheets must be strictly checked for falling by means of a number of sensors arranged along the path of transfer of the bunch. In this case, however, the manufacturing cost and the size of the apparatus increase, and sophisticated control is needed.

In the bunch transfer process, moreover, it is difficult to wind the bunch with a band of an optimum length, so that the band is delivered or paid out a little longer and unwound at the bundling section. Thus, the band unwinding time adds to the cycle time. Since the band is unwound even in case it is shorter than is needed, a band delivery roller is worn and lowered in life performance by skidding.

SUMMARY OF THE INVENTION

The present invention has been contrived in consideration of these circumstances, and its object is to provide a high-reliability sheet bundling apparatus capable of efficiently bundling sheets in a shorter cycle time and a sheet handling apparatus furnished with the same.

In order to achieve the above object, a sheet bundling apparatus according to the present invention is characterized in that a stacking plate, loaded with stacked sheets in a stacking position, is moved itself to a bundling position, and the sheets on the stacking plate are tied in the bundling position, whereby the cycle time is shortened, and the sheets are prevented from falling.

Specifically, the sheet bundling apparatus of the invention comprises a stacking plate movable between a stacking position and a bundling position; band supply means for delivering a band onto the stacking plate in the stacking position; stacking means for stacking a plurality of sheets in layers on the stacking plate in the stacking position while overlapping with the band delivered by the band supply means onto the stacking plate; moving means for moving the stacking plate from the stacking position to the bundling position in a manner such that the sheets stacked on the stacking plate are held between the moving means and the stacking plate; and bundling means for winding and bundling the sheets on the stacking plate moved to the bundling position with the band.

According to the sheet bundling apparatus constructed in this manner, the stacking plate is held in the stacking position, and the sheets are stacked in layers on the stacking plate, during the sheet stacking operation. When a predetermined number of sheets are stacked, they are pressed by the moving means from above and held between the moving means and the stacking plate. In this state, the sheets are moved together with the stacking plate to the bundling position. In the bundling position, the held sheets are wound and tied with the band by the bundling means.

Also, with the sheet bundling apparatus according to the invention, the band is fed onto the stacking plate before the sheets are stacked, and the sheets are put on the band when they are stacked on the stacking plate.

The sheet bundling apparatus according to the invention comprises curving means for curving the sheets, moved together with the stacking plate to the bundling position, by pushing up the side edge portions of the sheets, and the curved sheets on the stacking plate are wound and tied with the band. If the band is wound around the curved sheets, it can be wound tighter than when it is wound around flat sheets, and the bundling force of the band can be increased to ensure firm bundling of the sheets by releasing the sheets from the curvature after the winding.

A sheet handling apparatus according to the present invention comprises supply means for supplying a plurality of sheets, pickup means for picking up the sheets one after another from the supply means, transportation means for transporting the picked-up sheets along a fixed transportation path, discriminating means arranged along the transportation path, for detecting information from the sheets being transported, and a bundling apparatus for stacking and bundling each predetermined number of sheets discriminated by the discriminating means.

The bundling apparatus includes a stacking plate movable between a stacking position and a bundling position, stacking means for stacking the sheets in layers on the stacking plate in the stacking position, moving means for moving the stacking plate from the stacking position to the bundling position in a manner such that the sheets stacked on the stacking plate by the stacking means are held between the moving means and the stacking plate, curving means for curving the sheets, moved together with the stacking plate to the bundling position, by pushing up the side edge portions of the sheets, bundling means for winding and bundling the curved sheets on the stacking plate, moved to the bundling position, with the band, and discharging means for releasing the curved state of the sheets bundled by the band and discharging the sheets from the bundling plate.

According to the sheet handling apparatus constructed in this manner, the sheets supplied from the supply means are picked up one after another and transported along the fixed transportation path by the transportation means. The discriminating means detects various pieces of information, such as sheet size, pitches between the sheets, patterns, etc., from the sheets being transported. After passing through the discriminating means, the sheets are fed to the bundling means, whereupon they are stacked in lots, each including a predetermined number of sheets, e.g., 100 sheets, and are bundled with the band.

Further, a sheet handling apparatus according to the invention comprises first and second bundling apparatuses arranged side by side, and a band supply device for supplying a band alternatively to the first and second bundling apparatuses.

Each of the first and second bundling apparatuses includes a stacking plate movable between a stacking position and a bundling position, stacking means for stacking a plurality of sheets in layers on the band supplied from the band supply device and placed on the stacking plate in the stacking position, moving means for moving the stacking plate from the stacking position to the bundling position in a manner such that the sheets and the band stacked on the stacking plate are held between the moving means and the stacking plate, and bundling means for winding and bundling the sheets on the stacking plate moved to the bundling position with the band.

The band supply device includes a band roll formed by rolling the band, a band roll support portion supporting the band roll for rotation, a base portion supporting the band roll support portion for movement between a first position, in which the band roll faces the first bundling apparatus, and a second position, in which the band roll faces the second bundling apparatus, drive means for moving the band roll support portion between the first and second positions, band feeding means provided on the band roll support portion, for drawing out the band from the outer periphery of the band roll and feeding the band to the first or second bundling apparatus, and roll rotating means provided on the band roll support portion, for rotating the band roll to deliver the band to the band feeding means.

According to the sheet handling apparatus constructed in this manner, the band supply device faces the first or second bundling apparatus by moving between the first and second positions, and supplies the band alternatively to the two bundling apparatuses.

In the sheet handling apparatus according to the invention, moreover, the band supply device includes detecting means for detecting the trailing end portion of the band of the band roll and control means for stopping the operations of the band feeding means and the roll rotating means when the trailing end portion of the band is detected by the detecting means.

Further, the band supply device includes tensioning means provided on the band roll support portion, for engaging the corresponding band between the band roll and the band feeding means and applying tension to the band.

The tensioning means includes a tension roller, supported for movement along the outer periphery of the corresponding band roll between a standby position and the band feed means and in engagement with the band, and urging means for urging the tension roller toward the standby position. The tension roller is moved from the standby position toward the band feeding means by the band in response to feed operation of the band feeding means, and is returned to the standby position by the urging means in response to band delivery operation of the roll rotating means. The detecting means includes a detector for detecting the tension roller in the standby position.

Furthermore, the control means includes measuring means for measuring the time that elapses from the instant that the tension roller moves from the standby position until it returns to the standby position, and discriminating means for discriminating the trailing end portion of the band of the band roll when the measured time attains a predetermined value.

According to the band supply device constructed in this manner, the diameter of the band roll gradually decreases as the band is delivered from the roll. The band roll is rotated at a fixed speed by the roll rotating means. Accordingly, the time that elapses from the instant that the tension roller moves from the standby position until it returns to the standby position, during the band supply, gradually lengthens in proportion to the decrease of the band roll diameter. Thus, the band roll diameter, and therefore, the trailing end portion of the band or the band roll residue can be accurately detected by measuring this time interval.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiment of the invention, and together with the general description given above and the detailed description of the preferred embodiment given below, serve to explain the principles of the invention.

FIGS. 1 to 32 show a handling apparatus for securities according to an embodiment of the present invention, in which;

FIG. 1 is a sectional view schematically showing the handling apparatus;

FIG. 2 is a general perspective view of a bundling apparatus in the handling apparatus;

FIG. 3 is a plan view showing a band delivery device and a stacking plate of the bundling apparatus;

FIG. 4 is a side view showing the band delivery device and the stacking plate;

FIG. 5 is a perspective view showing a process for stacking or stacking securities on the stacking plate of the bundling apparatus;

FIG. 6 is a side view showing the process for stacking the securities on the stacking plate of the bundling apparatus;

FIG. 7 is a side view showing a principal part of the bundling device with the stacking plate, carrying the securities thereon, in a bundling position;

FIG. 8 is an exploded perspective view showing the stacking plate, a sweeper, and a curving device of the bundling apparatus;

FIG. 9 is a perspective view showing a principal mechanism with a band partially bound by a band binding device;

FIG. 10 is a side view showing a band bending device of the bundling apparatus;

FIG. 11 is a side view showing the band bending device with part of the band pressed against a bunch of securities;

FIG. 12 is a side view showing the band bending device with part of the band bent along the bunch;

FIG. 13 is a perspective view showing a thermocompression bonding device of the bundling apparatus, along with the sweeper and the bunch;

FIG. 14 is a side view showing the thermocompression bonding device in its standby state;

FIG. 15 is a side view showing the thermocompression bonding device subjecting the band to thermocompression bonding;

FIG. 16 is a perspective view showing a bunch discharging device of the bundling apparatus, along with the stacking plate and the bunch;

FIG. 17 is a side view showing the bunch discharging device in its standby state, along with the stacking plate, sweeper, and curving device;

FIG. 18 is a side view showing the bunch released from a binding effect of the curving device by the discharging device;

FIG. 19 is a perspective view of the discharging device with the bunch discharged;

FIG. 20 is a perspective view showing a band supply device of the bundling apparatus;

FIG. 21 is a side view of the band supply device;

FIG. 22 is a plan view of the band supply device;

FIG. 23 is a front view of the band supply device;

FIG. 24 is a side view of the band supply device cleared of its outside guide and loaded with no band roll;

FIG. 25 is a side view of the band supply device loaded with a band roll;

FIG. 26 is a block diagram schematically showing an outline of the bundling apparatus;

FIG. 29 is a timing chart showing the behavior of the bundling apparatus;

FIG. 30 is a flowchart showing the band supply operation and trailing end detecting operation of the band supply device;

FIG. 31 is a side view of the band supply device delivering the band; and

FIG. 32 is a side view of the band supply device with the band roll reduced in residual quantity.

DETAILED DESCRIPTION OF THE PREFERRED EMBODIMENTS

Figure 1:
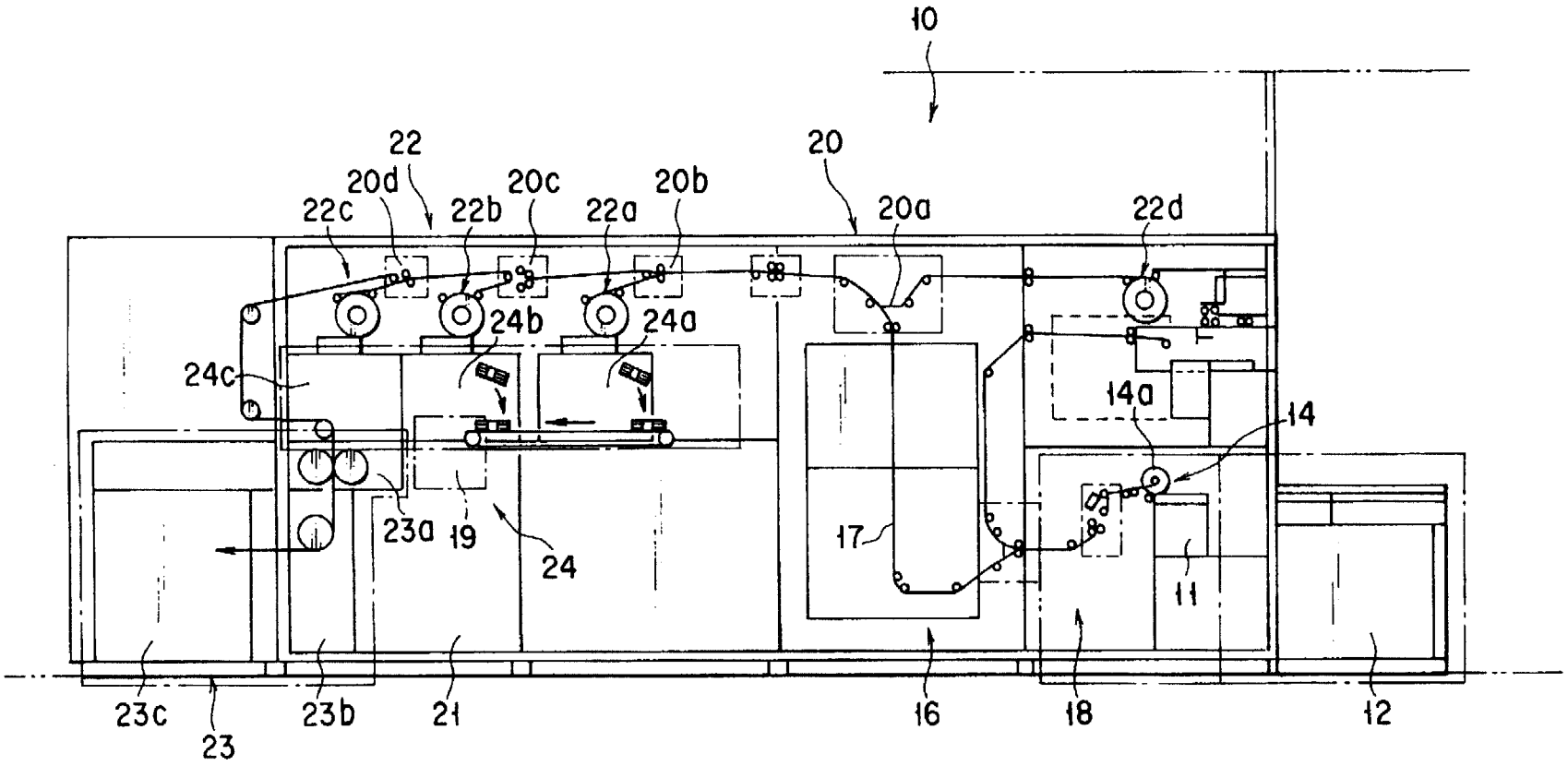

A sheet bundling apparatus according to an embodiment of the present invention, incorporated in a handling apparatus for securities, will now be described in detail with reference to the accompanying drawings. Referring first to FIG. 1, an outline of the handling apparatus will be described in brief.

A handling apparatus 10 for securities is designed so as to be able to handle a predetermined number of securities, e.g., 1,000 sheets, as each unit. Connected to the right-hand end portion of the handling apparatus is an introduction device 12, which automatically successively introduces 1,000 stacked securities in one lot.

The handling apparatus 10 comprises a pickup section 14 for picking up the introduced securities one after another, a conveyor device 16 as transportation means for transporting the picked-up securities along a fixed transportation path 17, and a discriminating section 18 as discriminating means for detecting several pieces of information, such as patterns, dimensions, transportation pitches, etc., from the securities being transported. The apparatus 10 further comprises a sorting section 20 for sorting the securities by the transportation direction in accordance with the result of the detection, a stacking section 22 for stacking the sorted securities, a bundling section 24 for bundling the stacked securities in lots, and an invalidating section 23 for cutting and storing the securities to be discarded.

A supply device 11, which serves as supply means, is provided in the vicinity of the pickup section 14 for use as pickup means. This supply device 11 receives securities P introduced through the introduction device 12, and supplies them to the pickup section 14. A suction roller **14*a* in the section 14 picks up the securities P one after another at regular pitches, and delivers them to the conveyor device 16. The conveyor device 16 has a plurality of conveyor belts, driving pulleys, driving motors, etc. arranged along the transportation path 17**.

The discriminating section 18 includes a superposed sheet detector for detecting superposition of the securities P being transported, a reader for reading patterns on the securities P, a counter for counting the securities P, etc. These elements are arranged in succession along the transportation path 17.

The securities P, subjected to counting, pattern reading, and length detection in the discriminating section 18, are sorted into a plurality of types, e.g., three types of sheets including normal sheets, soiled sheets, and unfit sheets (sheets to be rejected), in accordance with the result of the detection, and are discriminately collected according to the type. The sorting section 20 includes four distributing gates **20*a*, 20*b*, 20*c* and 20*d* in the transportation path 17. By alternatively switching each gate, the transportation path for the securities is switched, and each security is guided into the stacking section 22 or the invalidating section 23**, depending on the type.

The stacking section 22 is provided with two stacking devices **22*a* and 22*b* for stacking normal sheets, a stacking device 22*c* for stacking soiled sheets, and a stacking device 22*d* for stacking unfit sheets. The bundling section 24 is provided with three bunch bundling apparatuses 24*a*, 24*b* and 24*c* underlying the stacking devices 22*a*, 22*b* and 22*c*, respectively, a bundling section 19 for bundling a predetermined number of bunches of normal sheets tied by means of the bunch bundling apparatuses 24*a* and 24*b*, and a bundle packaging section 21. The invalidating section 23 for cutting soiled sheets is provided with two shredders 23*a* and 23*b* and a trash bin 23*c***.

The stacking devices **22*a*, 22*b*, 22*c* and 22*d* have the same construction, and the bunch bundling apparatuses 24*a*, 24*b* and 24*c* also have the same construction. Therefore, the respective constructions of the stacking device 22*a* and the bunch bundling apparatus 24*a*** will be described representatively in detail.

Figure 2:
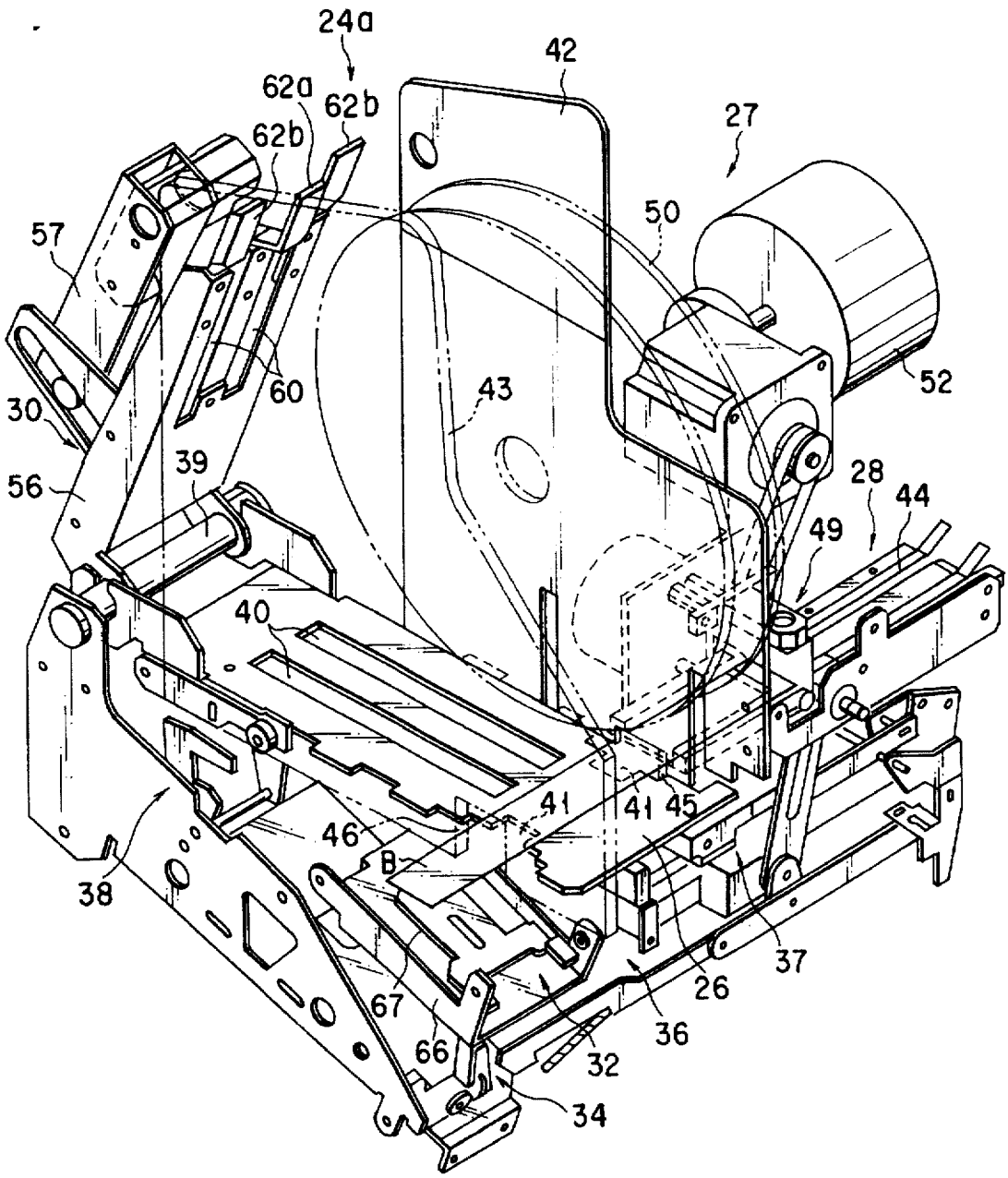

As shown in FIG. 2, the bunch bundling apparatus **24*a* according to the present embodiment is formed integrally with the stacking device 22*a***, and bundles each bunch including a predetermined number of stacked securities P, e.g., 100 securities, by means of a band.

First, an outline of the bunch bundling apparatus 24a will be described in brief. The apparatus 24a comprises an elongate rectangular stacking plate 26, a stacking runner unit 27 for receiving the securities P transported through the transportation path 17 and stacking them successively on the stacking plate 26, a delivery device 28 for delivering a band B onto the stacking plate 26, and a band supply device (mentioned later) for supplying the band to the delivery device. The bunch bundling apparatus 24a further comprises a sweeper device 30 for pressing down the bunch on the stacking plate 26 from above, curving device 32 for curving the stacked bunch around its longitudinal axis, a band bending device 34 for winding the band B around the bunch from the left-hand side, a band binding device 36 for pressing the band B against the right-hand side face of the bunch, a thermocompression bonding device 37 for subjecting the band B to thermocompression bonding, and a bunch discharging device 38 for discharging the tied bunch from over the stacking plate 26. All these devices are supported on a support frame (not shown) of the handling apparatus 10.

The following is a detailed description of the construction and operation of each of the aforesaid devices.

The stacking plate 26 has its rear end portion rotatably supported by a support shaft 39, and is kept in a horizontal state, normally. The plate 26 has a pair of slots 40 extending in its longitudinal direction, and a notch 41 is formed in each side edge of the distal end portion of the plate 26. A pair of parallel guide walls 42 and 43 are set up on either side of the stacking plate 26.

Figure 3:
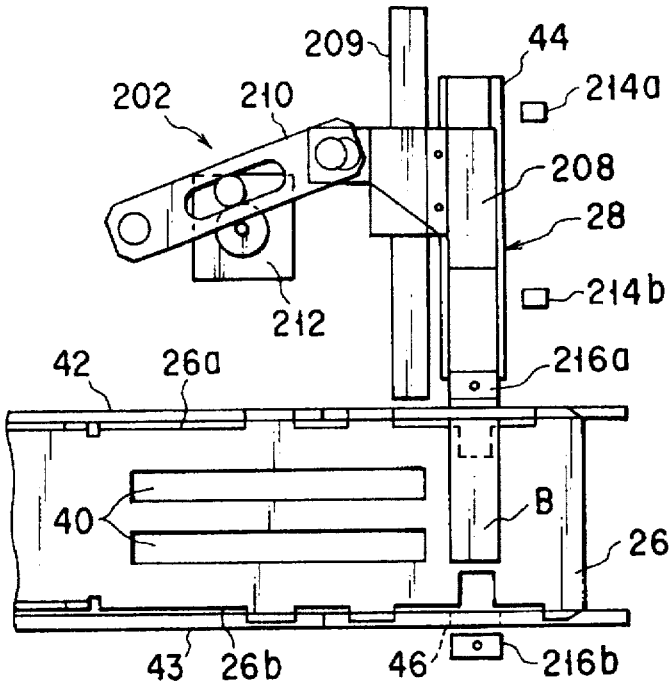
Figure 4:
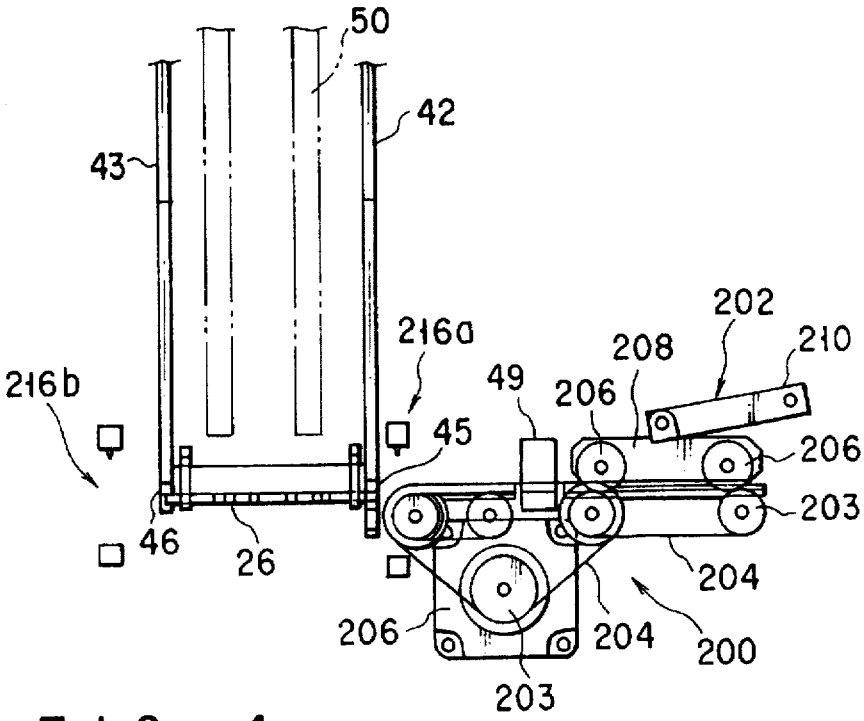

As shown in FIGS. 2 to 4, the stacking plate 26 has a right-hand side edge 26a as a first side edge and a left-hand side edge 26b as a second side edge. The delivery device 28 is located beside the front end portion of the right-hand side edge 26a of the stacking plate 26. The device 28 includes guide rails 44 extending substantially horizontally, and its front end is situated close to the guide wall 43. The band supply device (mentioned later) is located behind the delivery device 28 so as to be continuous therewith. The band supply device pulls out the band from a band roll and supplies it to the guide rails 44.

The delivery device 28 comprises a feed mechanism 200, which extends under and along the guide rails 44 and feeds the band B from the band supply device to the stacking plate 26, a band guide mechanism 202 for pressing down the band B on the guide rails 44 and guiding it, and a cutter 49 for as cutting means located over the guide rails 44 and adapted to be actuated by means of a solenoid 226 (mentioned later). The band B used is a tape coated with an adhesive that melts with heat.

The feed mechanism 200 includes a plurality of feed belts 204, passed around and between a plurality of pulleys 203 and arranged along the guide rails 44, and a feed motor 206 for driving the pulleys 203 to run the feed belts.

The band guide mechanism 202 includes a carrier 208, which holds a pair of guide rollers 206 in rolling contact with the upper surface of the feed belt 204, a support arm 209 supporting the carrier 208 for movement along the guide rails 44, and a guide motor 212 for driving a link mechanism 210 to reciprocate the carrier 208 along the rails 44. The carrier 208 is reciprocated between a home position in which it is detected by a first guide sensor 214a and an operating position in which it is detected by a second guide sensor 214b.

The delivery device 28 further comprises a first band sensor 216a as first band detecting means, which is situated close to the guide wall 42, and a second band sensor 216b as second band detecting means located beside the left-hand side edge 26b of the stacking plate 26 at a predetermined distance therefrom. The first and second band sensors 216a and 216b individually detect the position of the leading end of the band B delivered by the delivery device 28.

The supplied band B is guided by the guide rails 44 as it is delivered onto the stacking plate 26 through a notch 45 at the lower end of the guide wall 42, and is further delivered to a given length outside the guide wall 43 through a notch 46 at the lower end of the wall 43. The notches 45 and 46 have a width substantially equal to that of the band B, so that they can guide the band to prevent it from skewing as the band is delivered onto the stacking plate 26. The guide rails 44 are arranged so that the delivered band B can be situated over the notches 41 of the plate 26.

The band B is delivered in two stages. In a first stage, the band B is previously delivered up to a position such that its leading end adjoins the guide wall 42, that is, a position in which the leading end is detected by the first band sensor 216a, concurrently with other handling processes. In a second stage of delivery, the band B is delivered up to a position in which its leading end is detected by the second band sensor 216b as a bundling process is started, thereafter.

The stacking runner device 27, which functions as stacking means, comprises a runner 50, arranged between the guide walls 42 and 43 and overlying the stacking plate 26, and a stacking motor 52 for rotating the runner. The runner 50 includes a large number of radially extending blades, spaced in the circumferential direction and arranged in two rows. For simplicity of the drawing, these blades are illustrated by only indicating their outer peripheral edges by two-dot chain lines.

Figure 5:
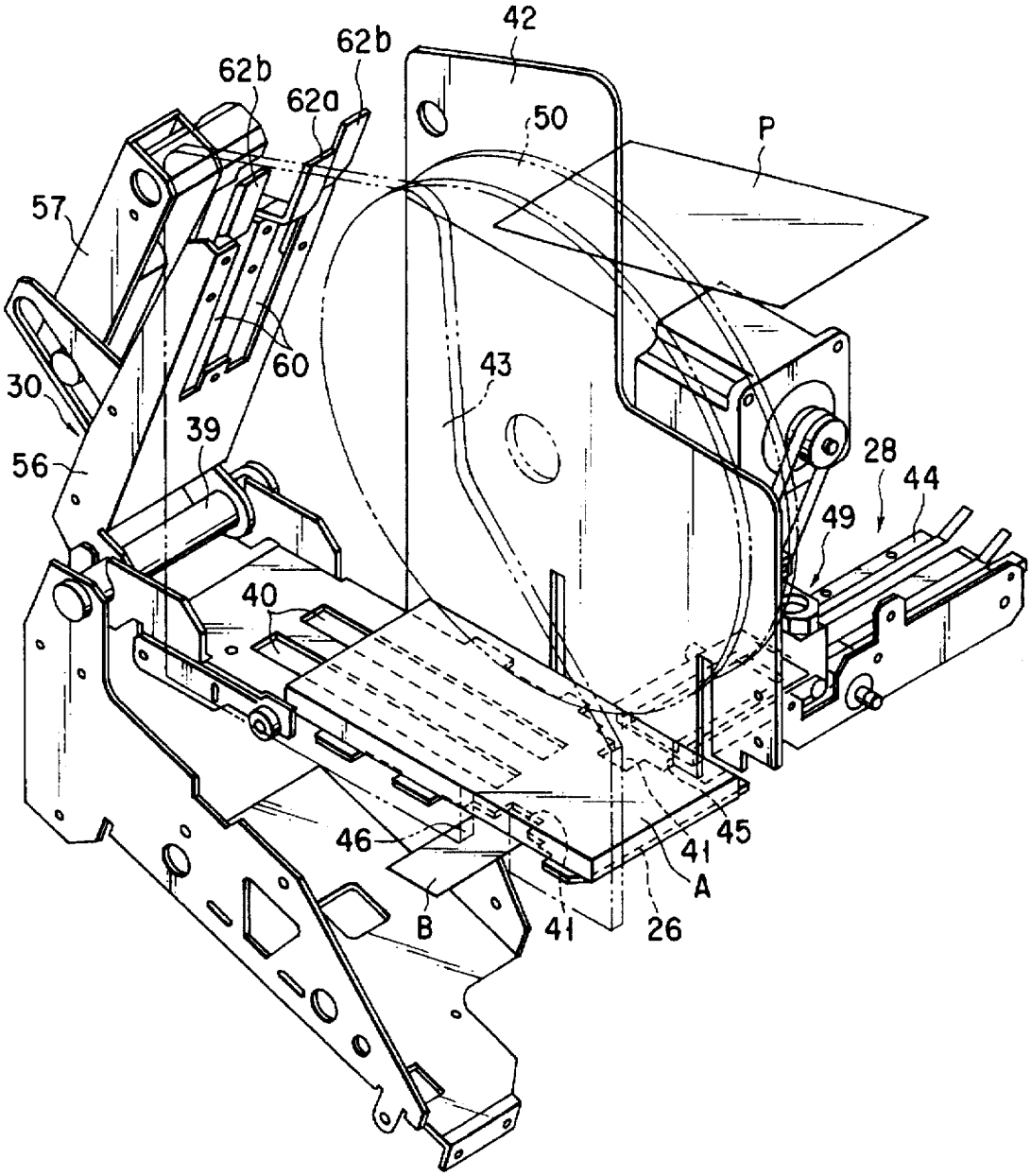
Figure 6:
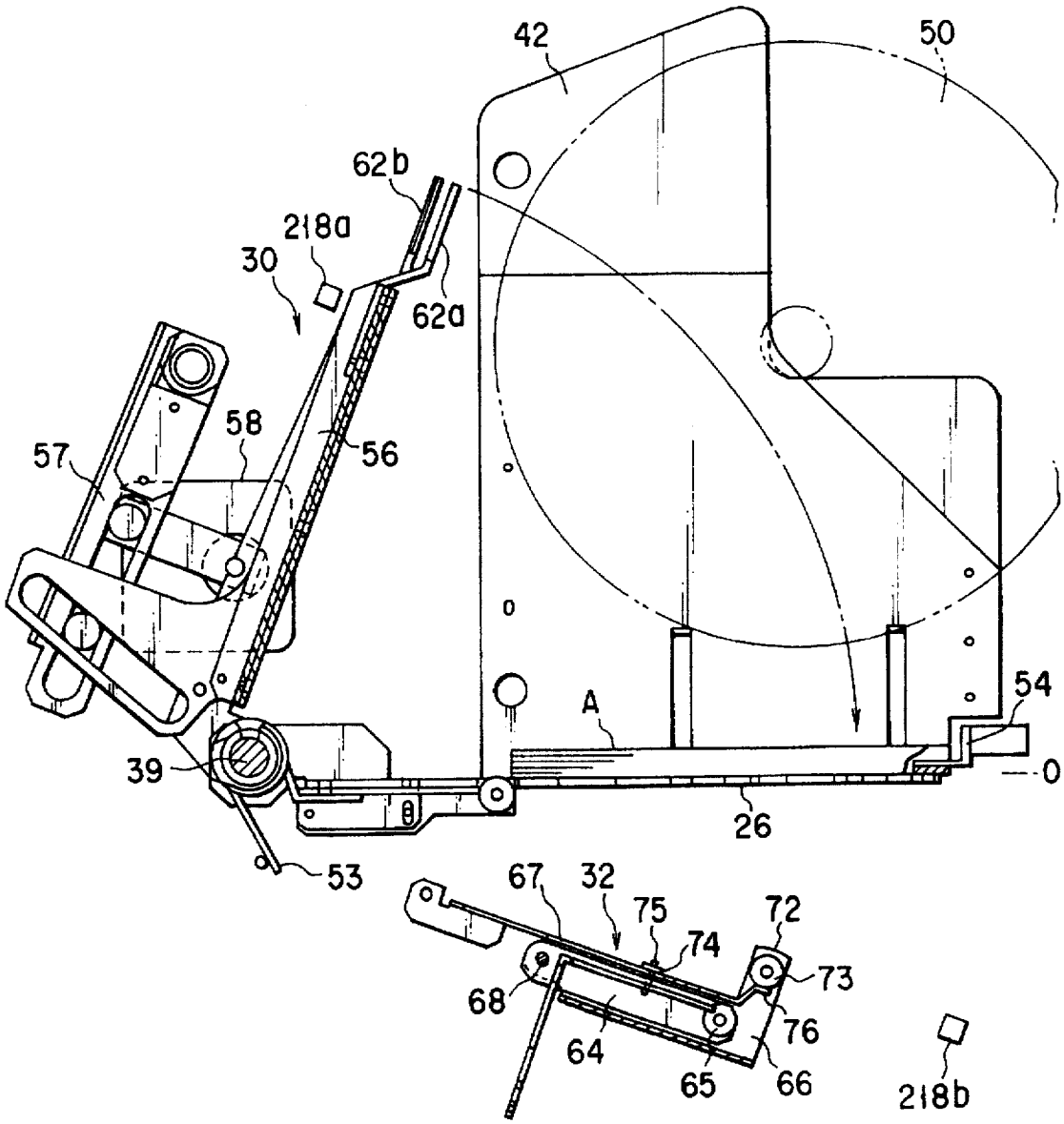

As shown in FIGS. 5 and 6, the securities P fed through the transportation path 17 are transported downward between the blades of the rotating stacking runner 50, and are then released from between the blades to be stacked successively on the stacking plate 26. The plate 26 is urged upward or in the counterclockwise direction of FIG. 6 by a torsion coil spring 53 that is wound around the support shaft 39. In a standby state for stacking, the stacking plate 26 is kept in a 0-degree position or horizontal stacking position, having its distal end portion in engagement with a stopper 54.

The stacking process is carried out so that the securities P on the stacking plate 26, detected by the discriminating section 18, are 100 in number. Thereupon, a bunch A including the 100 securities P rests on the delivered band B on the stacking plate 26.

As shown in FIGS. 5 and 6, the sweeper device 30 as moving means includes a plate-like sweeper 56, the rear end of which is rotatably supported by the support shaft 39. The sweeper 56 is connected to a sweeper motor 58 by means of a crank mechanism 57, and is rotated around the shaft 39 by actuating the motor 58.

The distal end portion of the sweeper 56 is formed with two parallel slits 60 such that it has the shape of three-pronged fork. These slits 60 serve to prevent the sweeper 56 from interfering with the stacking runner 50 when the sweeper 56 is rotated toward the stacking plate 26, as mentioned later.

Presser claws 62 are fixed individually to the respective distal ends of prongs of the sweeper 56 so as to extend forward and downward therefrom. Among these presser claws 62, a central presser claw 62a is formed so that its downward overhang is greater than those of presser claws 62b that are situated on either side.

While the securities P are being stacked, the sweeper 56 is kept in an open position such that it is upwardly inclined at 70° to the horizontal direction lest it interfere with the securities. When the sweeper 56 is in the open position, the crank mechanism 57 is deadlocked, so that the pulse motor 58 can hold the sweeper 56 without generating a substantial holding torque.

When a termination signal for the stacking process is received, the sweeper motor 58 for the sweeper device 30 is actuated, whereupon the sweeper 56 is rotated toward the stacking plate 26 by the crank mechanism 57. When the sweeper 56 is rotated to its horizontal position, its presser claws **62*a* and 62*b* are pressed against the upper surface of the bunch A on the stacking plate 26, thereby clamping the bunch A in conjunction with the plate 26. The claws 62*a* and 62*b*** are arranged, in particular, so that they abut against the bunch A over the band B.

Figure 7:
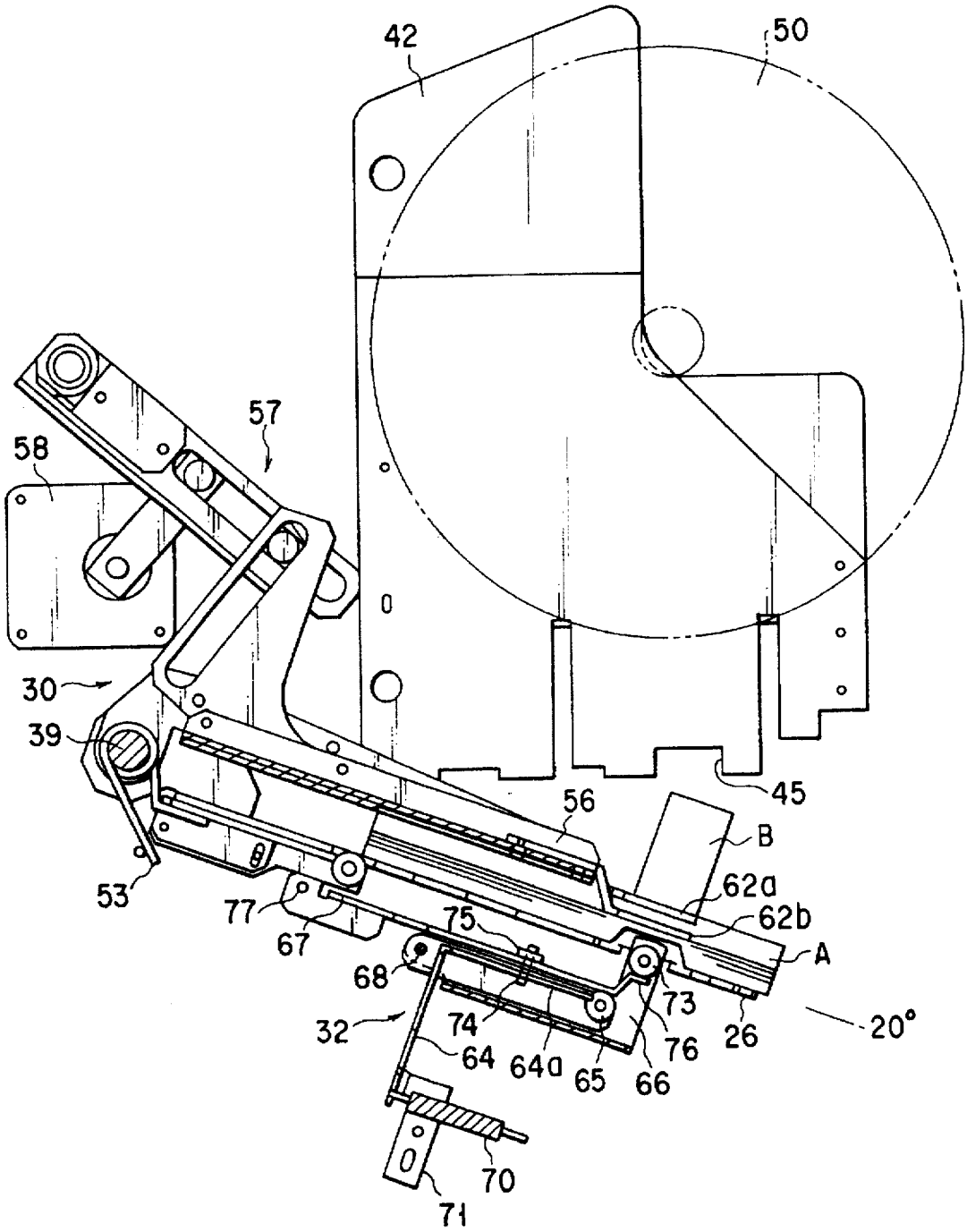

Further, the sweeper 56 is rotated to a bundling position such that it is inclined at −20° to the horizontal position, as shown in FIG. 7. As this is done, the sweeper 56 causes the stacking plate 26, bunch A, and band B to be rotated to and kept in the bundling position, resisting the urging force of the torsion coil spring 53, in a manner such that the bunch A and the band B are sandwiched between the sweeper 56 and the plate 26.

When the sweeper 56 is in the bundling position, as when in the open position, the crank mechanism 57 is deadlocked, so that the sweeper motor 58 can hold the sweeper 56 without generating a substantial holding torque. Since the stacking plate 26 is urged by the torsion coil spring 53, moreover, a slight change, if any, in the thickness of the bunch A in position that is attributed to variation in the quality of paper of the securities P or the like can be absorbed to allow the bunch A to be securely held between the plate 26 and the sweeper 56.

The sweeper 56 also has a function to scrape off any securities P remaining in the stacking runner 50 by passing through the runner 50 as it rotates from the open position to the bundling position. Further, the sweeper device 30 includes a first sweeper sensor **218*a* for detecting the rotation of the sweeper 56 toward the open position and a second sweeper sensor 218*b* for detecting the rotation of the sweeper 56** toward the bundling position.

As shown in FIGS. 2, 6, 7, 8 and 10, the curving device 32 for use as curving means underlies the stacking plate 26, and is inclined at −20° to the horizontal direction. The curving device 32 is comprised of an L-shaped curving stopper lever 64 supported on the support frame (not shown), a curving lever 66, and a curving release lever 67.

The intermediate portion of the curving stopper lever 64 is rotatably supported by a support shaft 68. Also, the lever 64 is urged to rotate counterclockwise around the shaft 68 by a tension spring 70, and is located in a standby position by engaging a stopper 71. When the stopper lever 64 is in the standby position, its support plate portion **64*a* is inclined at −20° to the horizontal direction. A guide roller 65 is attached to each side of the front end portion of the plate portion 64*a***.

The curving lever 66 has a substantially U-shaped cross section, and is located so as to span the support plate portion **64*a* of the curving stopper lever 64 from below. The rear end portion of the lever 66 is rotatably supported by the support shaft 68, and the respective front end portions of the opposite side faces thereof project toward the stacking plate 26, thus forming a pair of presser lugs 72, individually. A guide roller 73 is attached to the inner surface of each lug 72**.

The curving release plate 67 is movably mounted on the support plate portion **64*a* of the curving stopper lever 64. In particular, the release plate 67 is bound to be parallel to the plate portion 64*a* by means of a pin 74, which protrudes from the plate portion 64*a* and is inserted in a slot 67*a* of the plate 67, and a snap ring 75**.

The curving release plate 67 is substantially T-shaped, and its rear end is rotatably supported by a support shaft 77. Further, the release plate 67 has a pair of support claws 76 projecting from its front end portion and bent upward and forward. When the plate 67 is in its standby position, its lower surface is supported on the guide rollers 65 of the curving stopper lever 64, and the guide rollers 73 of the curving lever 66 are supported individually on the respective upper surfaces of the support claws 76. Thus, the curving lever 66 and the curving release plate 67 are kept inclined at −20° to the horizontal direction.

Figure 8:
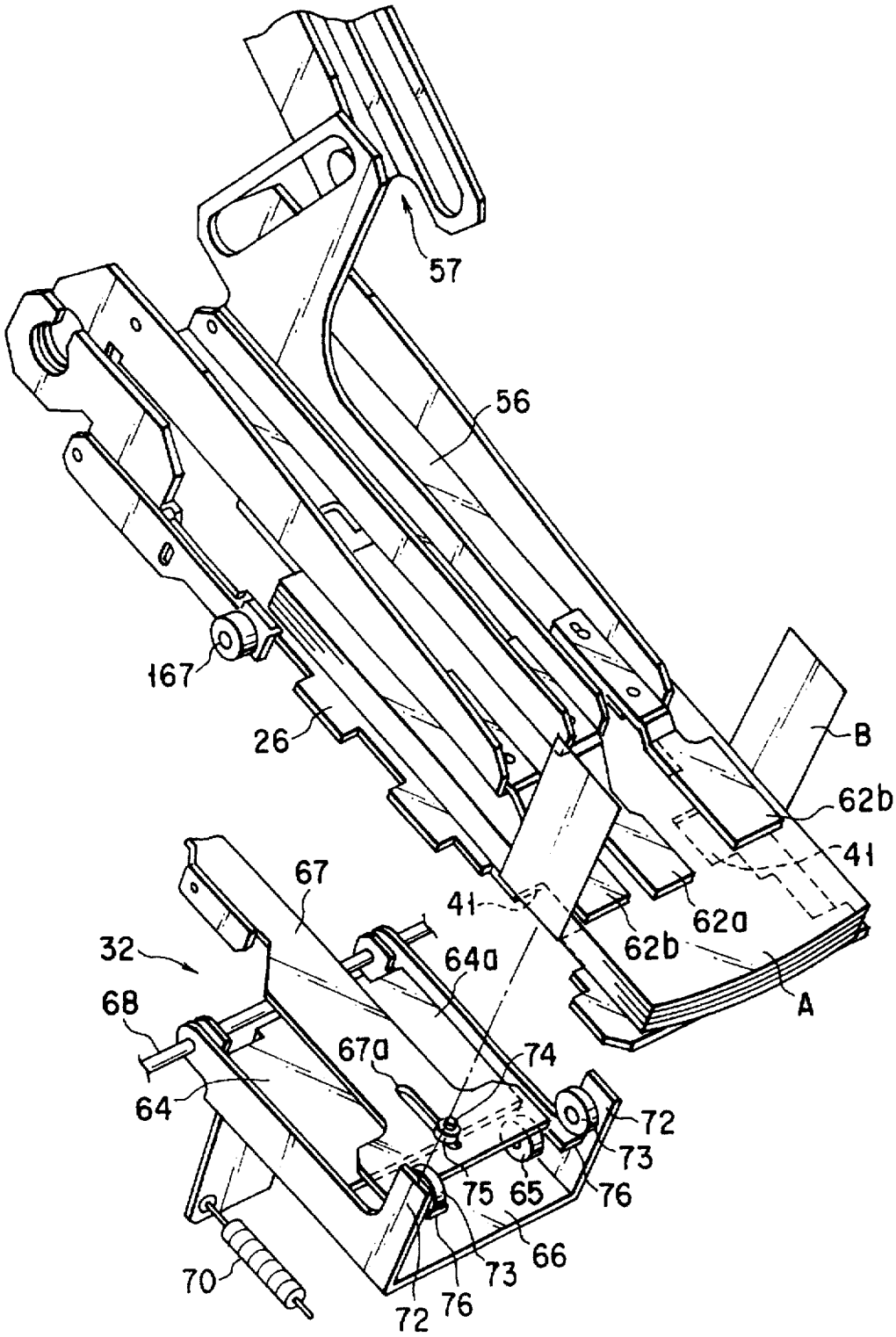

Constructed in this manner, the curving device 32 serves, in conjunction with the sweeper 56, to curve the bunch A on the stacking plate 26 around its longitudinal axis. Thus, when the sweeper 56, along with the plate 26 and the bunch A, rotates to the bundling position, the presser lugs 72 of the curving lever 66 held in the standby position abut individually against the opposite side edge portions of the lower surface of the bunch A and the band B through the notches 41 in the stacking plate 26, thereby pushing them up, as shown in FIGS. 7, 8 and 10.

Since the central presser claw **62*a* of the sweeper 56 hangs down deeper than the side presser claws 62*b*, on the other hand, the bunch A is held heavily in its central portion and softly in the opposite side edge portions. Thus, the side edge portions of the bunch A are pushed up by an interaction between the presser claws 62*a* and 62*b* and the presser lugs 72**, so that the bunch A is curved around its longitudinal axis.

Since the curving stopper lever 64 is urged by the tension spring 70, a slight change, if any, in the thickness of the bunch A in position that is attributed to variation in the quality of paper of the securities P or the like can be absorbed to prevent an excessive load from acting on the curving device 32 and the sweeper device 30.

Figure 9:
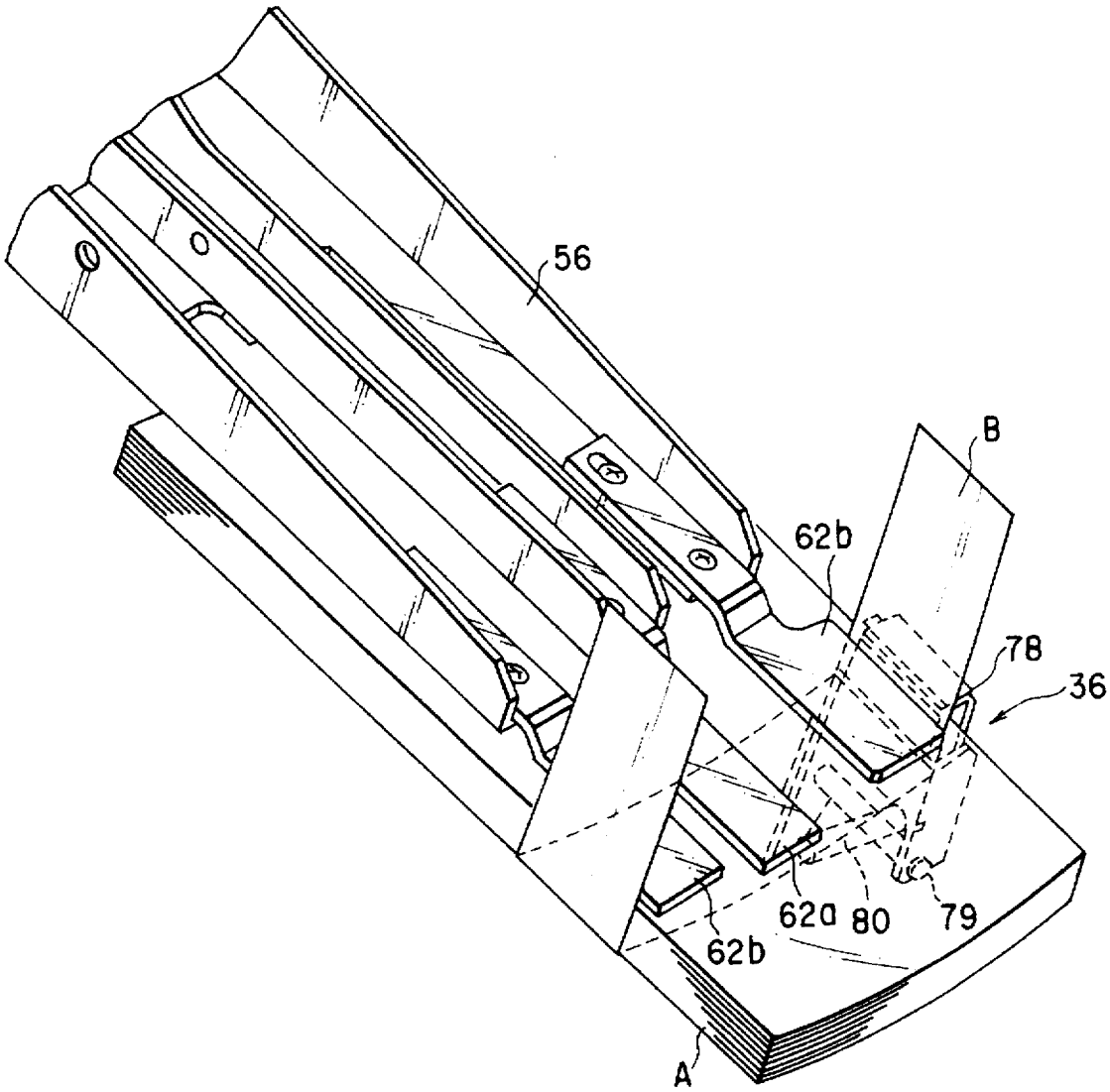
Figure 10:
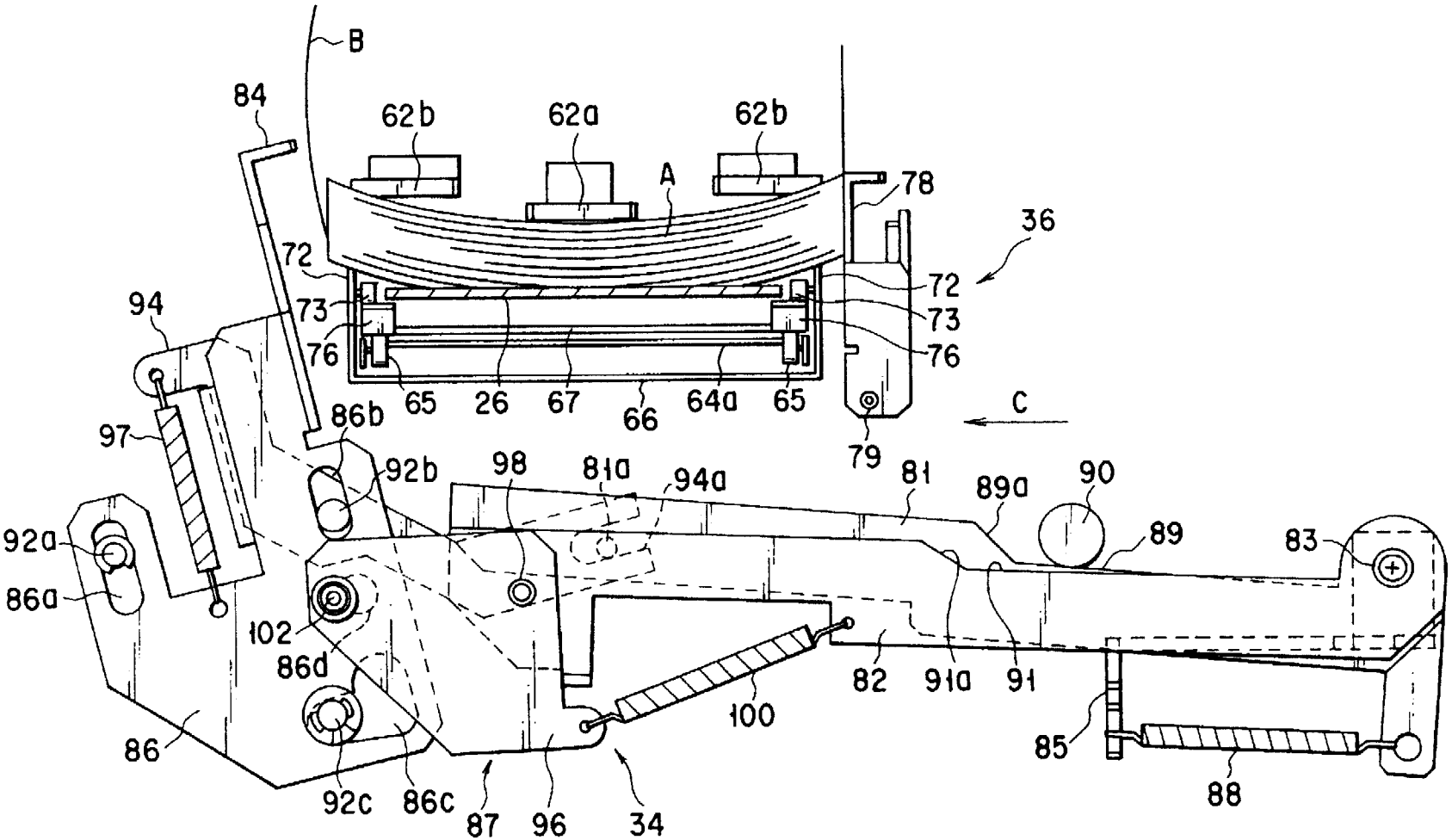

When the band B is in the bundling position, as shown in FIGS. 9 and 10, its rear end portion, which projects from the right-hand side of the bunch A, is bent upward along the right-hand side face of the bunch A by the band binding device 36 for use as band binding means. More specifically, the binding device 36 is provided with an upright binding lever 78, which is supported by a support shaft 79 for rotation through an infinitesimal angle. The lever 78 is urged to press the bunch A from the right-hand side by a tension spring 80.

When the bunch A, along with the stacking plate 26, rocks to the bundling position, therefore, the binding lever 78 abuts against that portion of the band B which projects from the right-hand side of the bunch A, thereby bending the extending portion along the right-hand side face of the bunch A and holding it in position. Also, the lever 78 presses the band B tight against a side face of the bunch A by means of the urging force of the tension spring 80, thereby preventing the band from slackening.

Thus, when the stacking plate 26, bunch A, and band B are rotated from the stacking position to the bundling position by the sweeper 56, the curving process by means of the curving device 32 and the bending process for the right-hand side portion of the band B by means of the band binding device 36 are carried out simultaneously.

Subsequently, that portion of the band B which projects from the left-hand side of the bunch A is bent along the left-hand side face of the curved bunch and the upper surface of the presser claw 62b by the band bending device 34 for use as band bending means. As shown in FIGS. 2 and 10, the bending device 34 comprises first and second elongate cam plates 81 and 82 extending substantially horizontally at right angles to the stacking plate 26, a moving plate 86 formed integrally with an L-shaped bending arm 84 for bending the band B, and a crank mechanism 87 for actuating the moving plate 86 in association with the rocking motion of the cam plates.

The respective right-hand end portions of the first and second cam plates 81 and 82 are rockably supported on a support frame 85 by means of a support shaft 83. The first cam plate 81 is urged to rock counterclockwise around the shaft 83 by a tension spring 88 that is stretched between plate 81 and the frame 85. The upper edge of the first cam plate 81 forms a cam face 89, which engages a cam follower 90, whereby the plate 81 is held in its initial position shown in FIG. 10. The cam face 89 has an upwardly slanting portion 89a in the middle.

Likewise, the upper edge of the second cam plate 82 forms a cam face 91, which has an upwardly slanting portion 91a in the middle. The cam follower 90 is attached to the thermocompression bonding device 37, as mentioned later, and moves horizontally in the direction of arrow C as the device 37 is actuated.

The moving plate 86 has a pair of parallel guide holes 86a and 86b extending substantially vertically, an L-shaped guide hole 86c, and a guide hole 86d extending substantially in the horizontal direction. The bending arm 84 extends upward from the moving plate 86 in a direction parallel to the guide holes 86a and 86b.

Guide pins 92a, 92b and 92c, which protrude from the support frame (not shown), are fitted in the guide holes 86a, 86b and 86c in the moving plate 86, respectively. Thus, the plate 86 is confined to a plane, and is allowed only to move up and down and rotate within the same plane.

The crank mechanism 87 is provided with a rocking arm 94 and a connecting plate 96. The intermediate portion of the arm 94 is rockably supported by a guide pin 92b. A notch 94a is formed at one end of the arm 94, and a pin 81a, which protrudes from the left-hand end portion of the first cam plate 81, is fitted in the notch 94a. A tension spring 97 is stretched between the other end of the rocking arm 94 and the moving plate 86.

The connecting plate 96 is rockably supported on the left-hand end portion of the second cam plate 82 by means of a support pin 98, and is urged to rock counterclockwise around the pin 98 by a tension spring 100 that is stretched between plates 96 and 82. Further, a connecting pin 102 protrudes from the connecting plate 96, and is fitted in the guide hole 86d of the moving plate 86.

When the cam follower 90 moves in the direction of arrow C, in the band bending device 34 constructed in this manner, the slanting portion 89a of the first cam plate 81 is first pressed by the follower 90, and the plate 81 is rocked counterclockwise around the support shaft 83, resisting the urging force of the tension spring 88. As the first cam plate 81 is rocked in this manner, the rocking arm 94 is pressed by the pin 81a, and rocks counterclockwise around the guide pin 92b.

Figure 11:
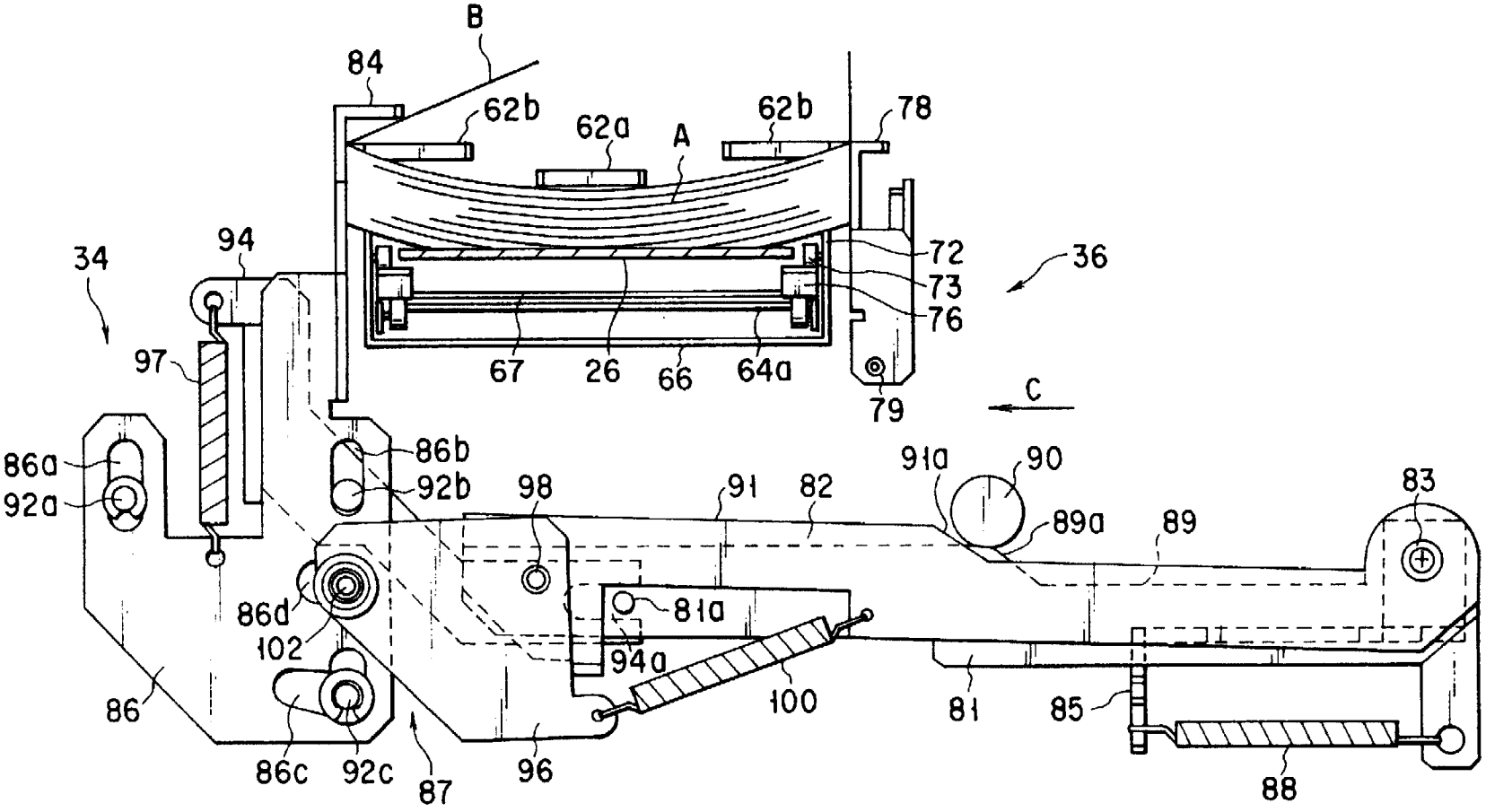

The rocking force of the rocking arm 94 is transmitted to the moving plate 86 through the tension spring 97, so that the plate 86 is rocked counter-clockwise substantially around the guide pin 92b, as shown in FIG. 11. As this is done, the moving plate 86 is assisted in rocking by the urging force of the tension spring 100 transmitted through the connecting plate 96. As the moving plate 86 rocks in this manner, the bending arm 84 rocks to a substantially vertical position, thereby pressing the band B against the left-hand side face of the bunch A.

Figure 12:
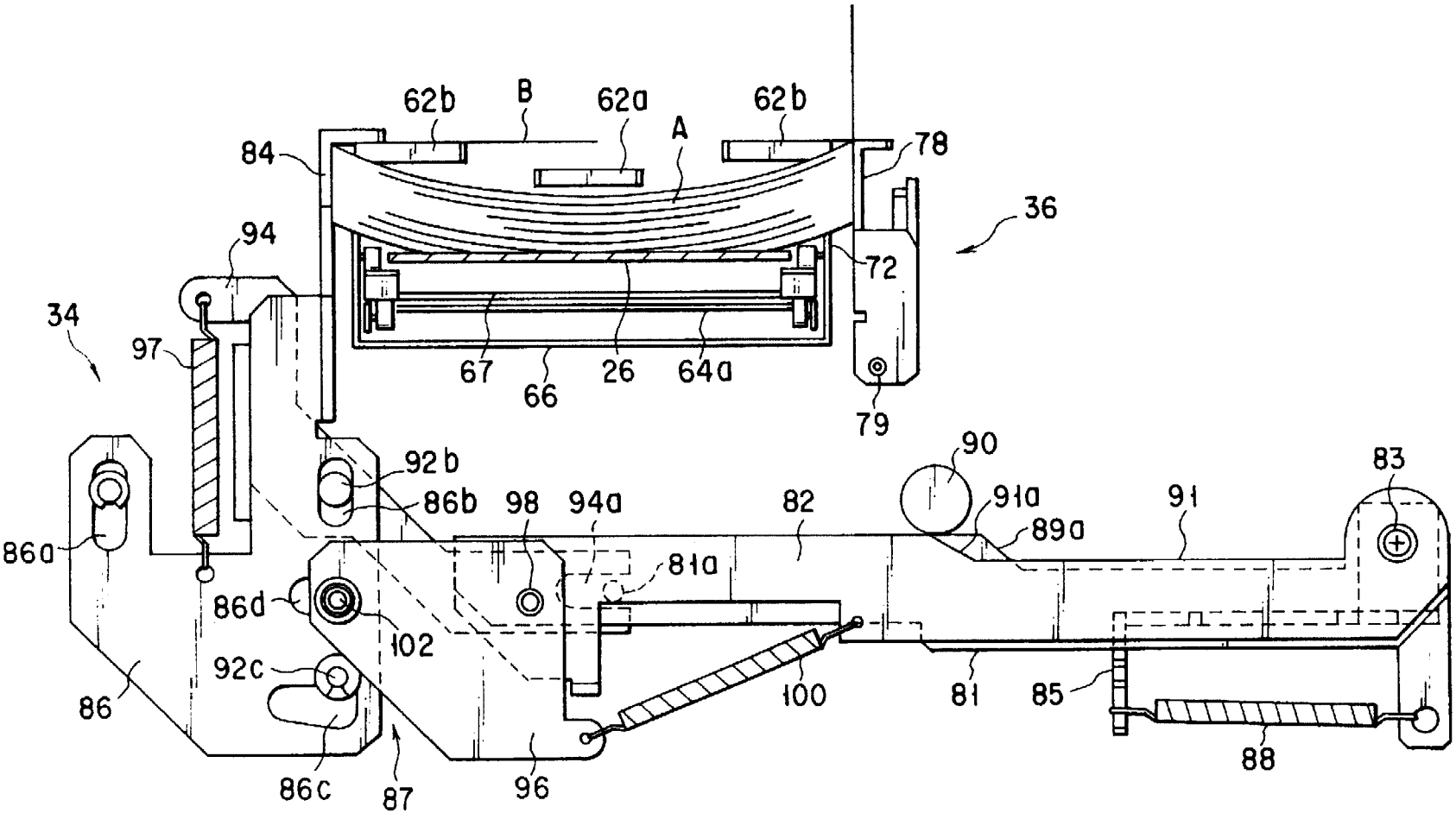
Figure 13:
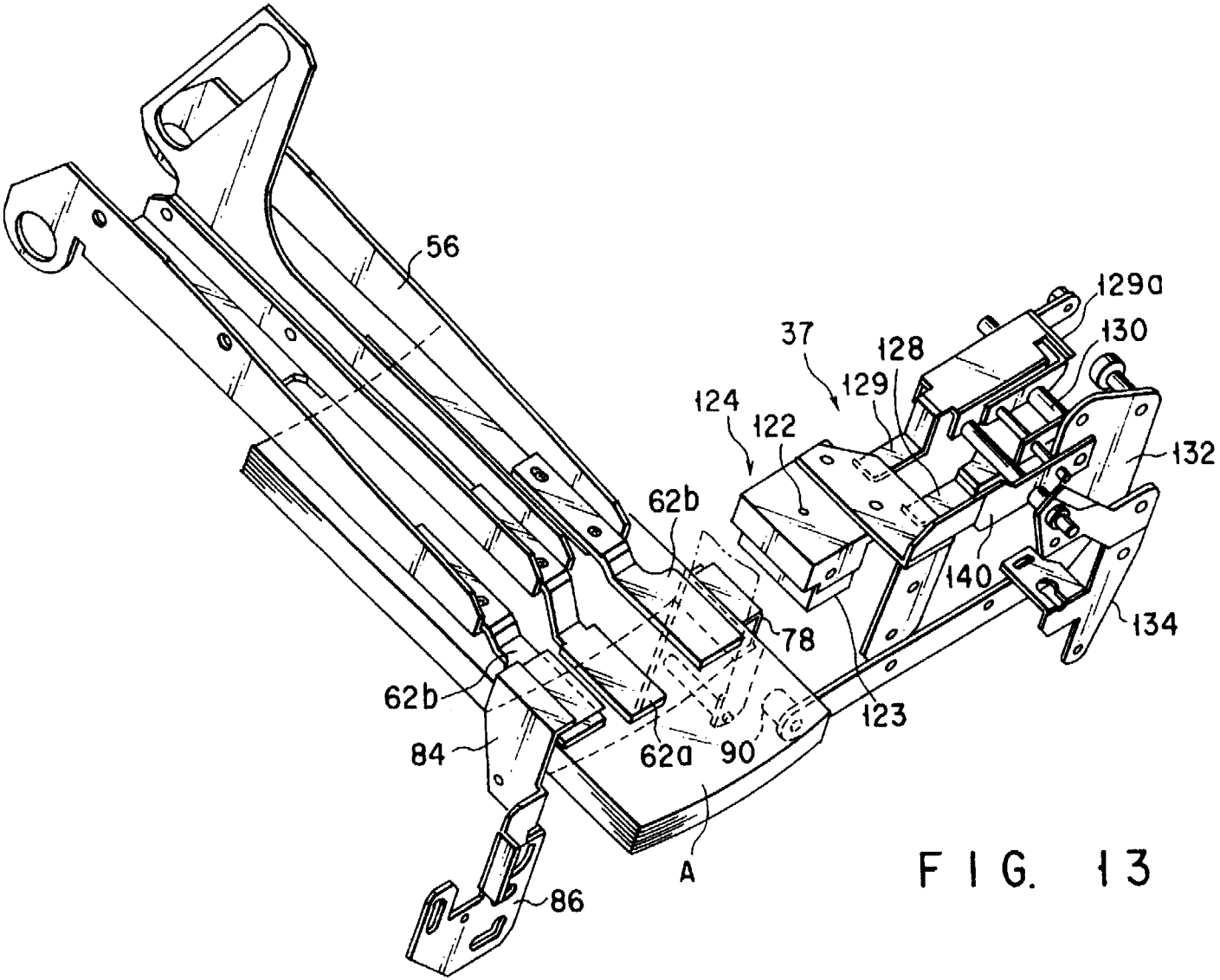

When the cam follower 90 further moves in the direction of arrow C, thereafter, it engages the slanting portion 91a of the second cam plate 82, and causes the plate 82 to rock counterclockwise around the support shaft 83, as shown in FIGS. 12 and 13. Then, the support pin 98 lowers together with the second cam plate 82, thereby causing the connecting plate 96 to move the moving plate 86 downward. Thereupon, the bending arm 84 descends together with the plate 86, and the distal end portion of the L-shaped arm 84 bends the band B at a right angle along the presser claws 62a and 62b of the sweeper 56.

When the second cam plate 82 rocks, the moving plate 86 descends integrally with the connecting plate 96 unless the tension spring 100 is subjected to a higher load than expected. In case an extraordinary load acts on the moving plate 86, however, the spring 100 lengthens as the cam plate 82 rocks, and only the connecting plate 96 rocks around the pin 98. Thus, the second cam plate 82, connecting plate 96, etc. can be prevented from being damaged by an excessive load.

As mentioned before, the cam follower 90 is attached to the thermocompression bonding device 37, and moves in the direction of arrow C as the device 37 is actuated. When the bonding device 37 is driven, therefore, the band bending device 34 is actuated. When the bonding device 37 returns to its initial position, the bending operation by the bending device 34 is canceled.

The thermocompression bonding device 37, for use as thermocompression bonding means, moves forcing down the band B from the right-hand side of the bunch A, and subjects an overlapping portion of the band B to thermocompression bonding from above at its stroke end. After standing by for a given period of time, the device 37 returns to the initial position. The first and second cam plates 81 and 82 are actuated immediately when the operation of the bonding device 37 is started. Therefore, the left-hand side portion of the band B never fails to be bent before the right-hand side portion is forced down.

Figure 14:
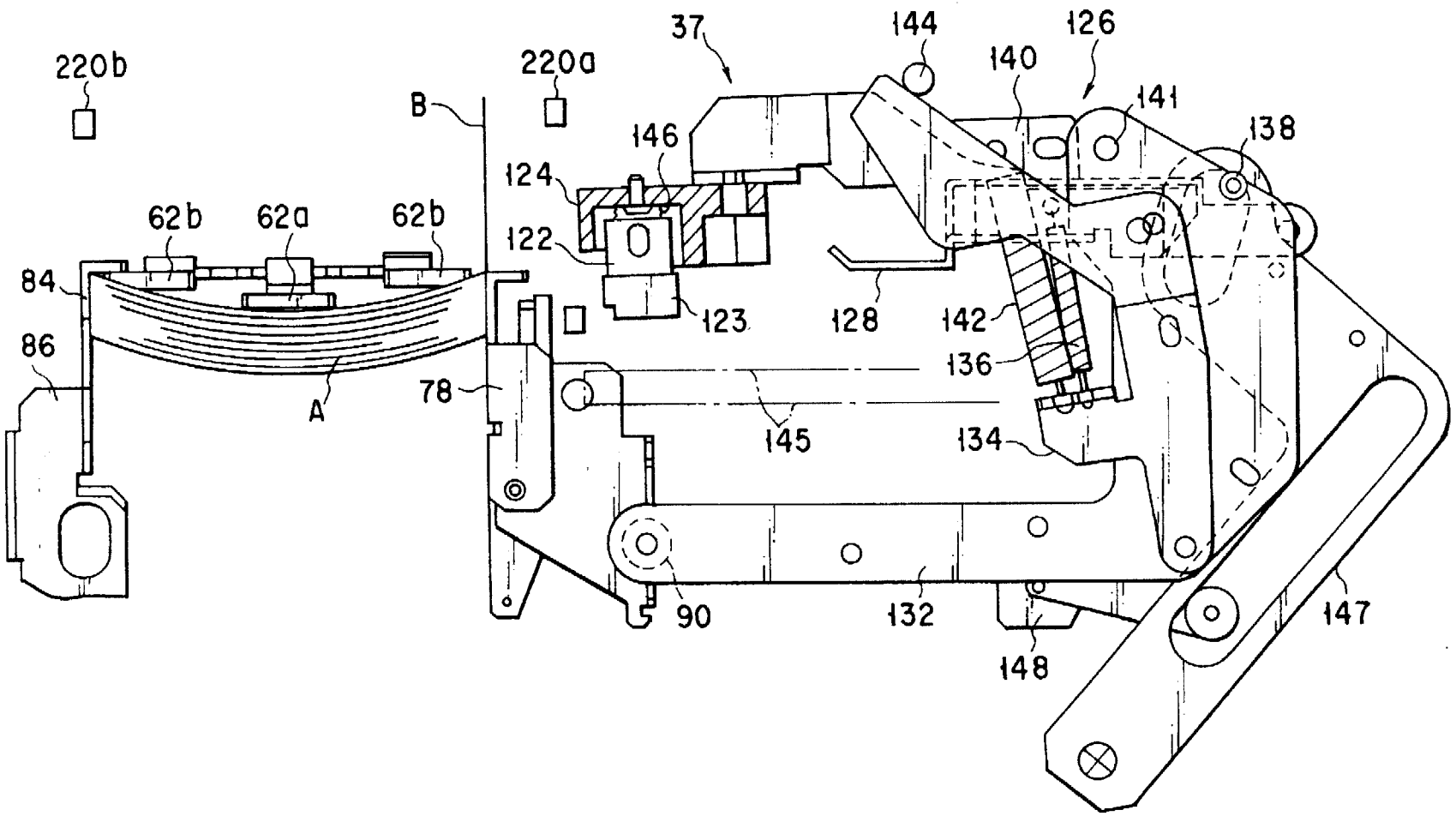

As shown in FIGS. 13 and 14, the thermocompression bonding device 37 comprises a stationary heater 123 fixed and held in position on the support frame (not shown), a contact-bonding head 124 having a movable heater 122, and a band stretching mechanism 126 that moves parallel with the head 124. The mechanism 126, which constitutes band laying means, includes a pair of band laying levers 128 and 129. These levers are supported for independent rocking motion by a support pin 130 that is fixed to a base plate 132. The lever 129 has a stopper 129a that can engage the lever 128. When it is subjected to a clockwise torque around the support pin 130, the lever 129 can rock independently unless the stopper 129a engages the lever 128. The base plate 132 is movable parallel with the contact-bonding head 124 and the band laying levers 128 and 129, and the cam follower 90 is mounted on the distal end of the lower end portion of the plate 132.

A pressure cam plate 134 is rockably mounted on the base plate 132. The band laying levers 128 and 129 are urged individually downward by a pair of tension springs 136 that are stretched between the levers and the cam plate 134, and are positioned by means of a cam plate (not shown). The positioning by means of this cam plate prevents the levers 128 and 129 from coming into contact with the contact-bonding head 124. In case the bunch A moved to the bundling position by the sweeper 56 is deviated at an infinitesimal angle from its predetermined position, the independent rocking of the pair of levers 128 and 129 can absorb the deviation in position between the band stretching mechanism 126 and the bunch.

The contact-bonding head 124 is fixed to the distal end of a heater arm 140, the rear end portion of which is rockably supported on the base plate 132 by means of a pin 141. A tension spring 142 is stretched between the heater arm 140 and the pressure cam plate 134 so that the arm 140 and the plate 134 pull each other. In its standby position, the cam plate 134 abuts against a stopper pin 144, whereby it is restrained from rocking, and the heater arm 140 is urged to rock counterclockwise around the pin 141 by the spring 142.

The movable heater 122 is supported on the contact-bonding head 124 by means of a spring 146, and is self-aligning, so that it can absorb a deviation in position from the bunch. The stationary heater 123 is mounted on a fixed frame (not shown) and held in position. In its standby position, the moevable heater 122 is pressed against the stationary heater 123 by means of the urging force of the tension spring 142, and is subjected to heat from the stationary heater.

Figure 15:
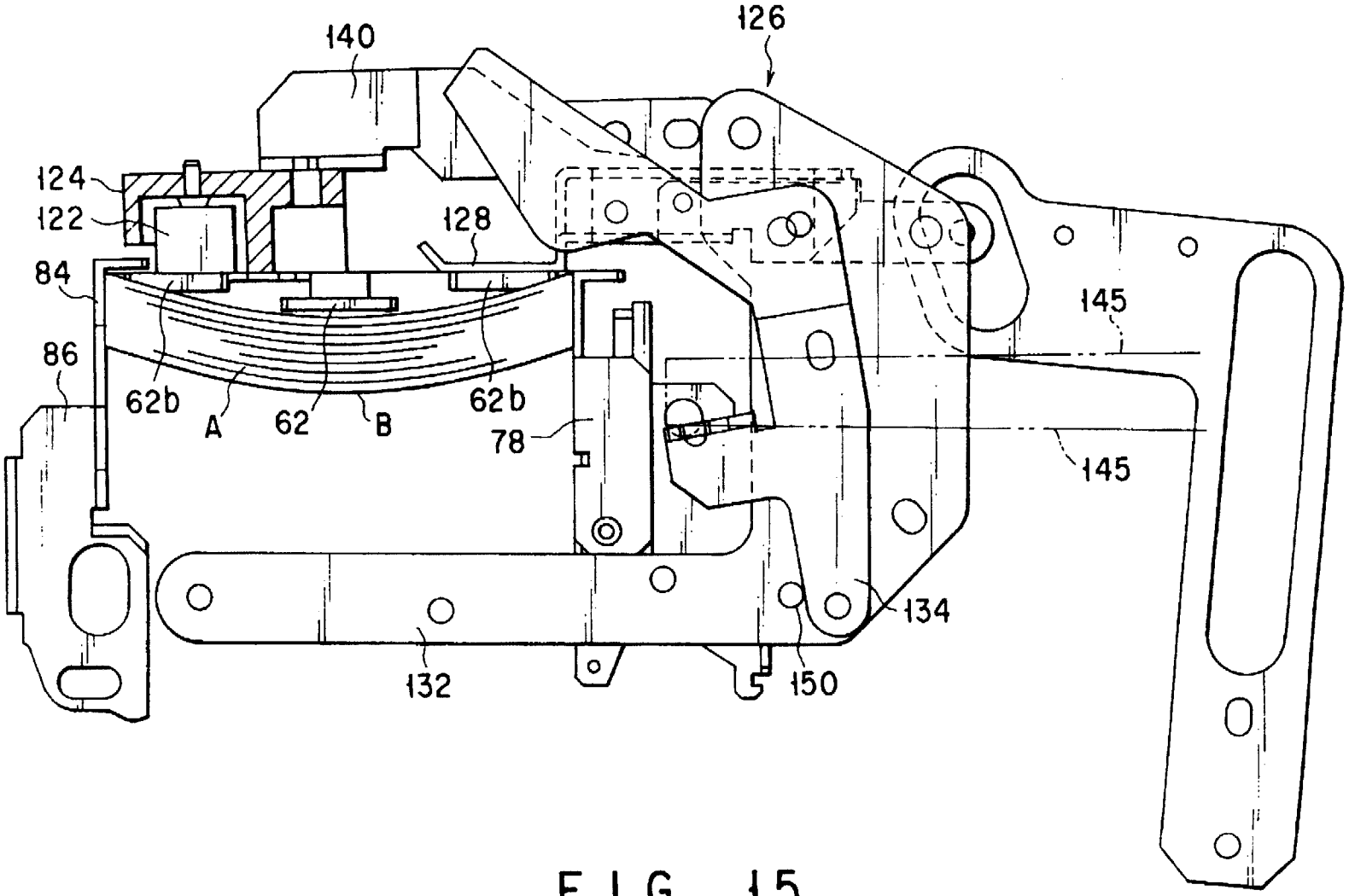

As shown in FIGS. 14 and 15, the band stretching mechanism 126 includes a guide rail 145 that extends horizontally, and the base plate 132 is supported for parallel movement by the rail 145. Further, the mechanism 126 includes a swinging arm 147 for moving the plate 132 parallel and a driving motor 148 for driving the arm 147.

When the swinging arm 147 is rocked by the driving motor 148, the base plate 132 is moved by means of a cam follower 138 that is mounted on the support pin 130, and the band stretching mechanism 126 moves from its standby position toward the bunch A, thus reaching a contact-bonding position shown in FIG. 15. While the mechanism 126 is moving to the contact-bonding position, the pair of band laying levers 128 and 129 bring down the right-hand side portion of the band B by abutting against it, thereby superposing its end portion on the leading end of the left-hand side portion of the band. In the contact-bonding position, moreover, the pressure cam plate 134 abuts against a pin 151, whereby it is restrained from rocking in the clockwise direction. Thereupon, the levers 128 and 129 and the contact-bonding head 124 are pressed toward the band B by means of the urging force of the tension springs 136 and 142.

Accordingly, the movable heater 122 is pressed against the overlapping portion of the band B and heats it. The opposite end portions of the band B are bonded together by holding the contact-bonding head 124 in the contact-bonding position for a given period of time. Since the movable heater 122 is supported by the tension spring 146, it can align itself with the contact-bonded portion of the band B, so that a slight angular deviation or the like, if any, can be absorbed with ease.

The bunch A is bundled with the band B in the operation described above. The thermocompression bonding device 37, along with the band bending device 34 and the band binding device 36, constitutes bundling means according to the present invention.

After the aforementioned contact-bonding process is finished, the contact-bonding head 124 is returned to its standby position, whereupon the band bending device 34, holding the left-hand side portion of the band B, is also returned to its initial position. Before a removal process for the bunch A is carried out, the bunch A is released from the binding by the sweeper 56 and the curving lever 66. This is done because if the bunch A is kept bound by the sweeper 56 and the lever 66 as it is discharged, only the bunch is discharged with the bonded band B left as it is.

Figure 16:
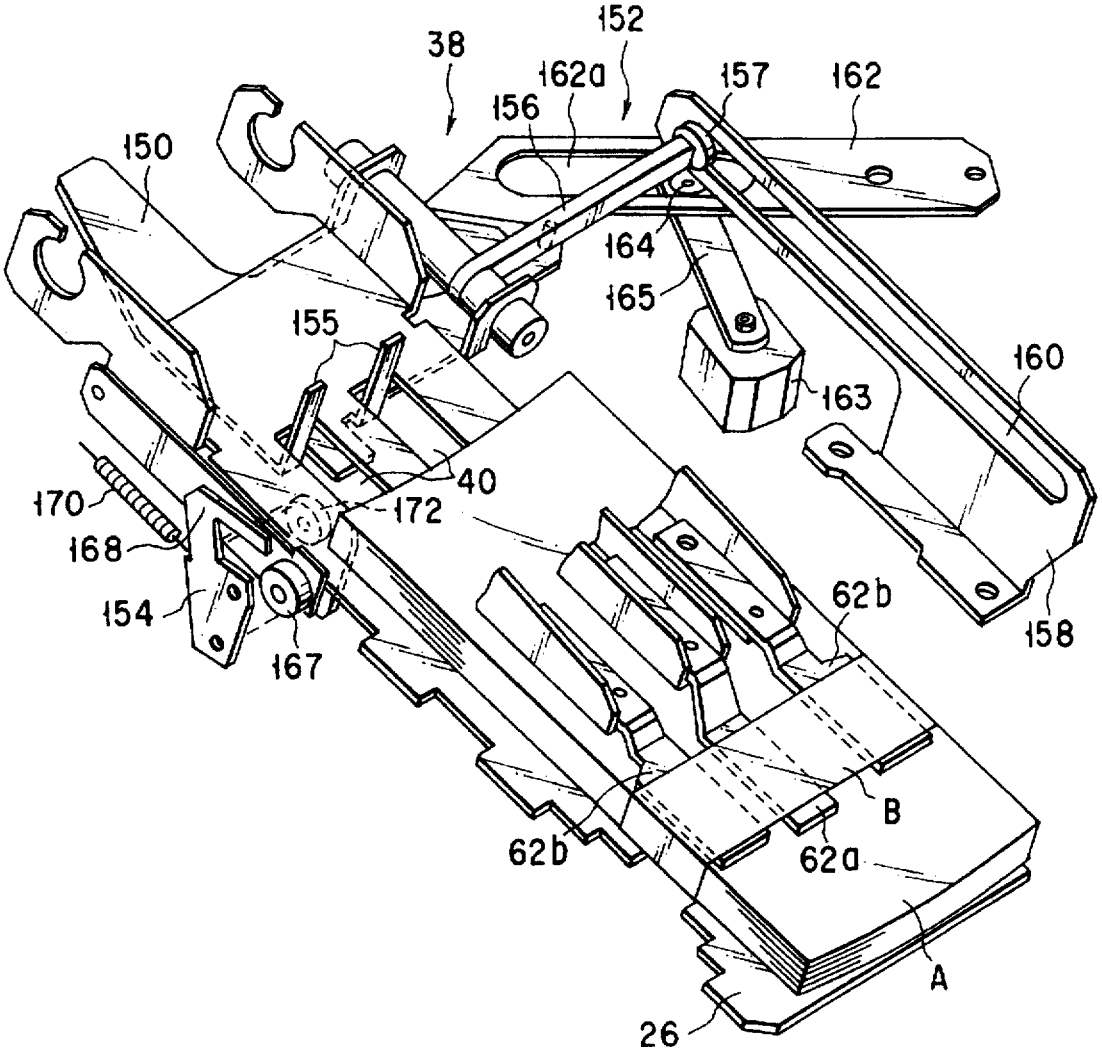
Figure 17:
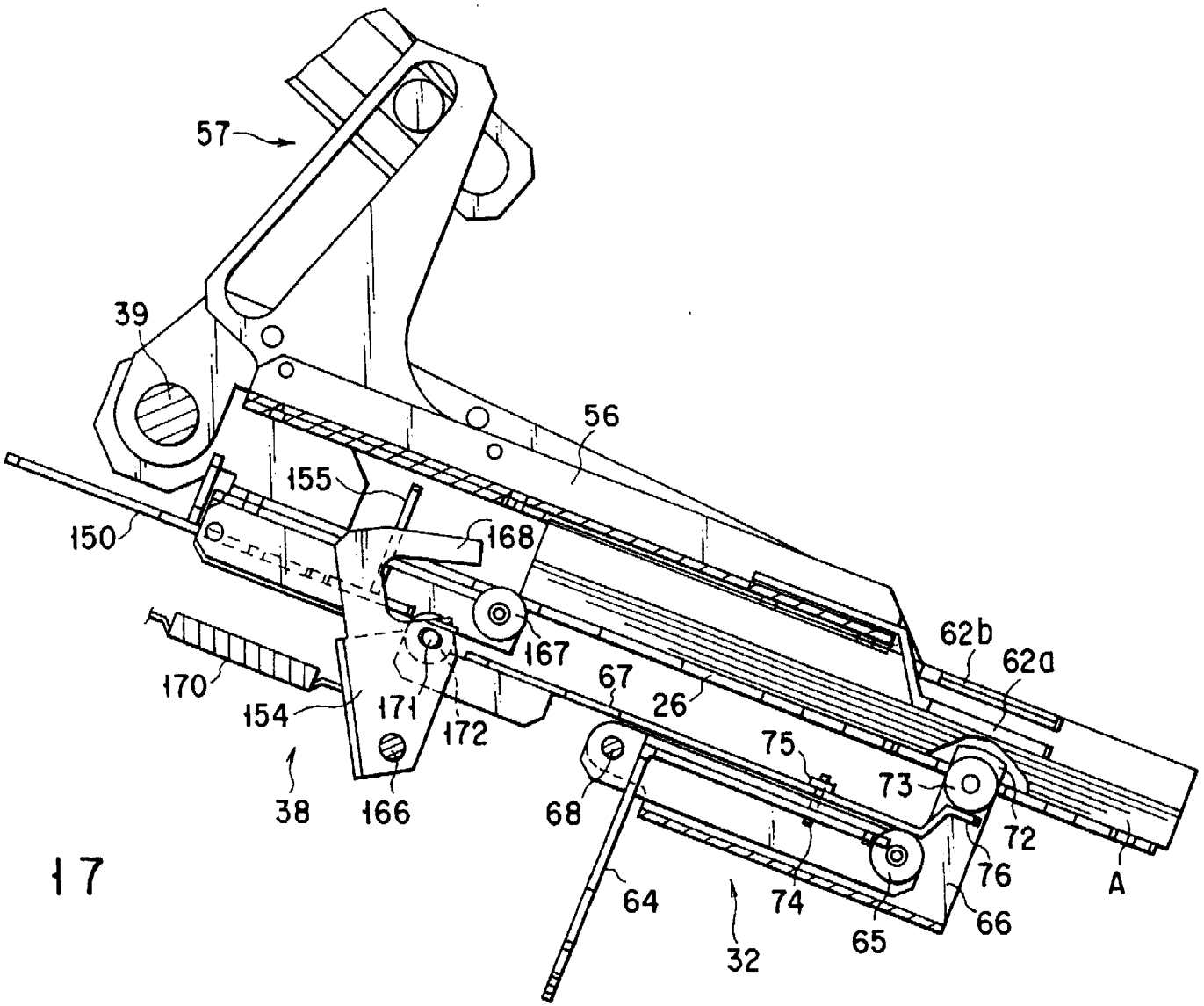

The aforesaid binding release operation is carried out in association with the bunch removal process by means of the curving device 32 and the bunch discharging device 38. As shown in FIGS. 16 and 17, the device 38 for use as discharging means comprises a discharging plate 150 situated opposite the lower surface of the stacking plate 26 in the bundling position, a drive mechanism 152 for reciprocating the plate 150 in a direction at an angle of −20° to the horizontal direction, and a locking lever 154 rockably mounted on the support frame (not shown). The lever 154, in conjunction with the discharging plate 150, locks the stacking plate 26 in the bundling position.

The discharging plate 150 has a pair of discharging claws 155 that extend upward. These claws 155 project above the stacking plate 26 through a pair of apertures 40 in the plate 26, and move individually in the apertures 40 as the discharging plate moves. A stationary stud 156 is fixed to a side end of the discharging plate 150, and a guide roller 157, which is attached to the distal end of the stud 156, is fitted in a guide slot 160. The slot 160 is formed in a guide plate 158, which is fixed to the support frame (not shown), and extends in the −20° direction. Thus, the plate 150 is bound for parallel movement.

The drive mechanism 152 is provided with a rocking arm 162, a driving motor 163, and a driving arm 165 connected to the motor 163. The rocking arm 162 has one end rockably supported on the support frame (not shown) and the other end rockably connected to the discharging plate 150. The driving arm 165 has a guide roller 164 that is fitted in a guide slot **162*a* in the rocking arm 162**.

The locking lever 154 is supported on the support frame (not shown) for rocking motion around a support shaft 166, and has a hook 168 capable of engaging a locking roller 167 that is mounted on a side face of the stacking plate 26. In the standby state, the lever 154 is urged to move away from the roller 167 by a tension spring 170 that is stretched between the lever 154 and the support frame, and is positioned by means of a stopper (not shown).

A guide roller 172 is mounted on the locking lever 154 by means of a support shaft 171, and is situated in the path of transfer of the discharging plate 150. The rear end of the curving release plate 67 of the curving device 32 is rockably supported by the shaft 171.

Figure 18:
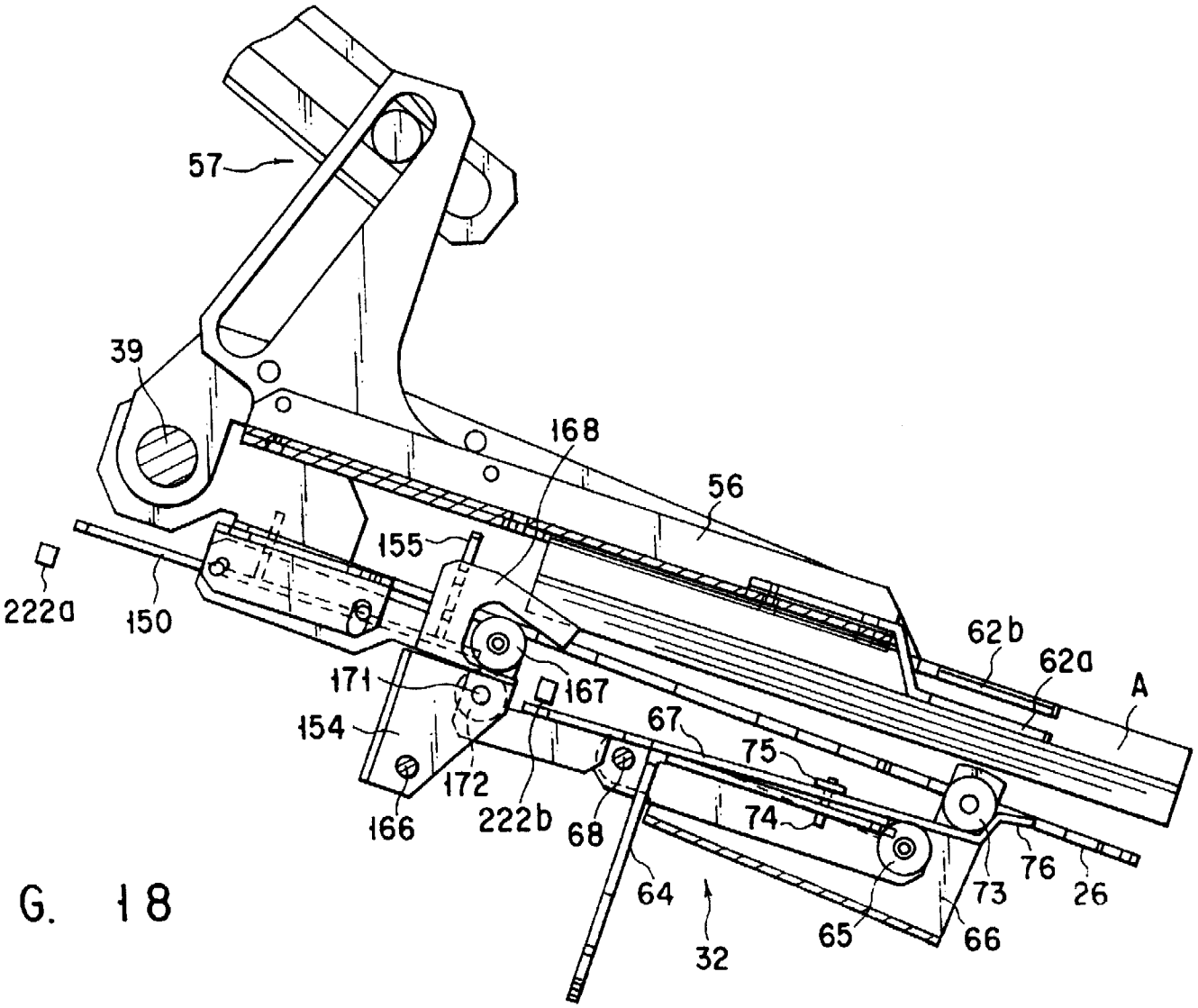

In releasing the binding and discharging the bunch, the drive mechanism 152 of the bunch discharging device 38 is first actuated, whereupon the discharging plate 150 is moved forward from its standby position shown in FIGS. 16 and 17 to its discharging position. While the plate 150 is moving to the discharging position, its distal end first engages and presses the guide roller 172 of the locking lever 154. Thereupon, the lever 154 rocks clockwise around the support shaft 166, resisting the urging force of the tension spring 170, so that the hook 168 engages the locking roller 167 of the stacking plate 26, thereby locking the plate 26 in the bundling position, as shown in FIG. 18.

As the locking lever 154 rocks in this manner, moreover, the support shaft 171 moves forward, so that the curving release plate 67 supported by the shaft 171 also moves forward. Thereupon, the support claws 76 of the plate 67 are disengaged individually from the guide rollers 73 of the curving lever 66, so that the lever 66 is released from the binding. Thus, the curving lever 66 rocks downward around the support shaft 68 through an angle corresponding to the height of each claw 76, whereupon the presser lugs 72 of the lever 66 are separated from the lower surface of the bunch A. As a result, the bunch A is released from the binding by the curving lever 66 and the presser claws 62*a* and 62*b* of the sweeper 56. When the binding is canceled, moreover, the bunch A is restored from the curved state to the flat state by its own elasticity, so that it is tied firm with the band B under an increased tension.

Figure 19:
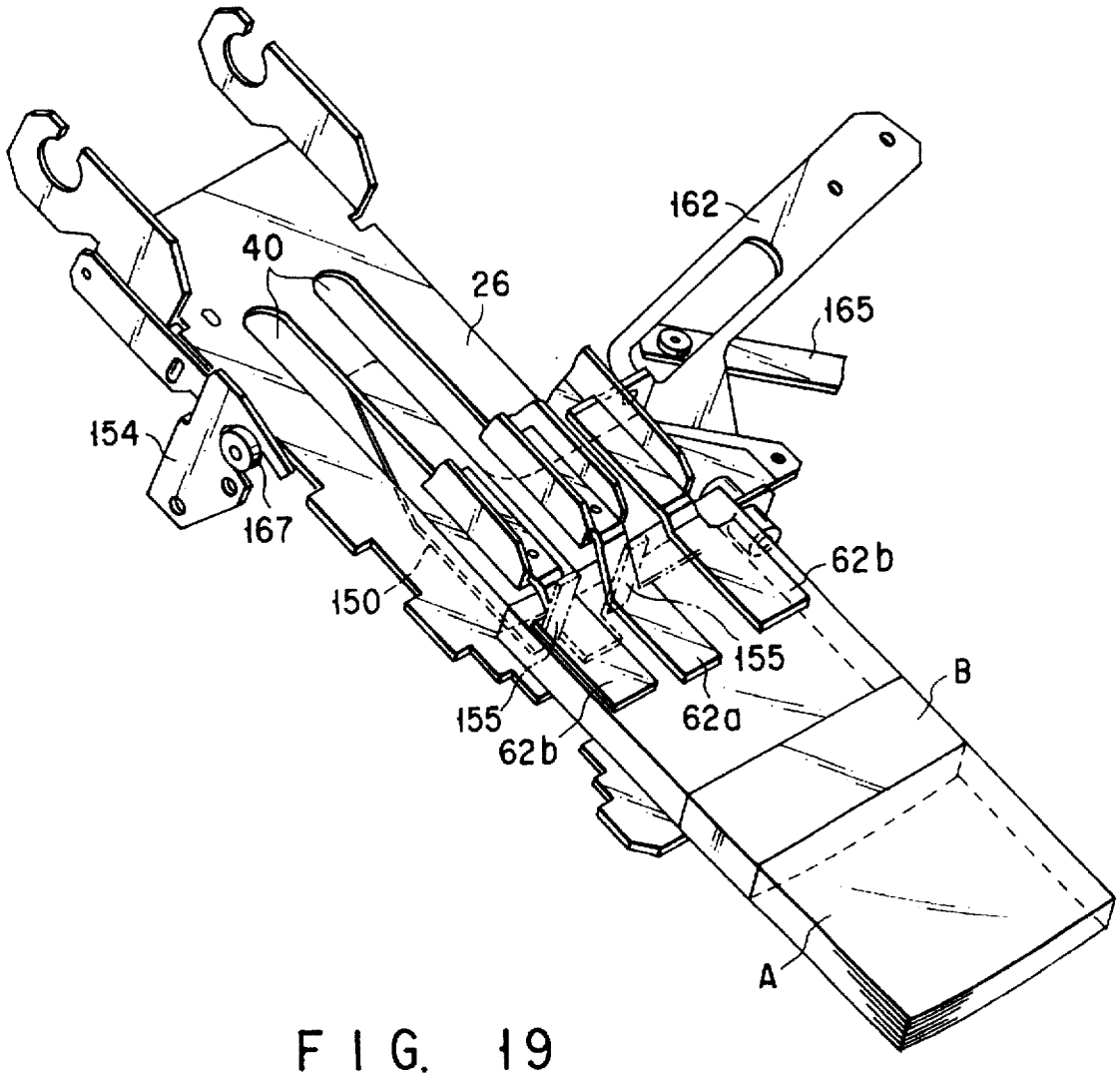
Figure 20:
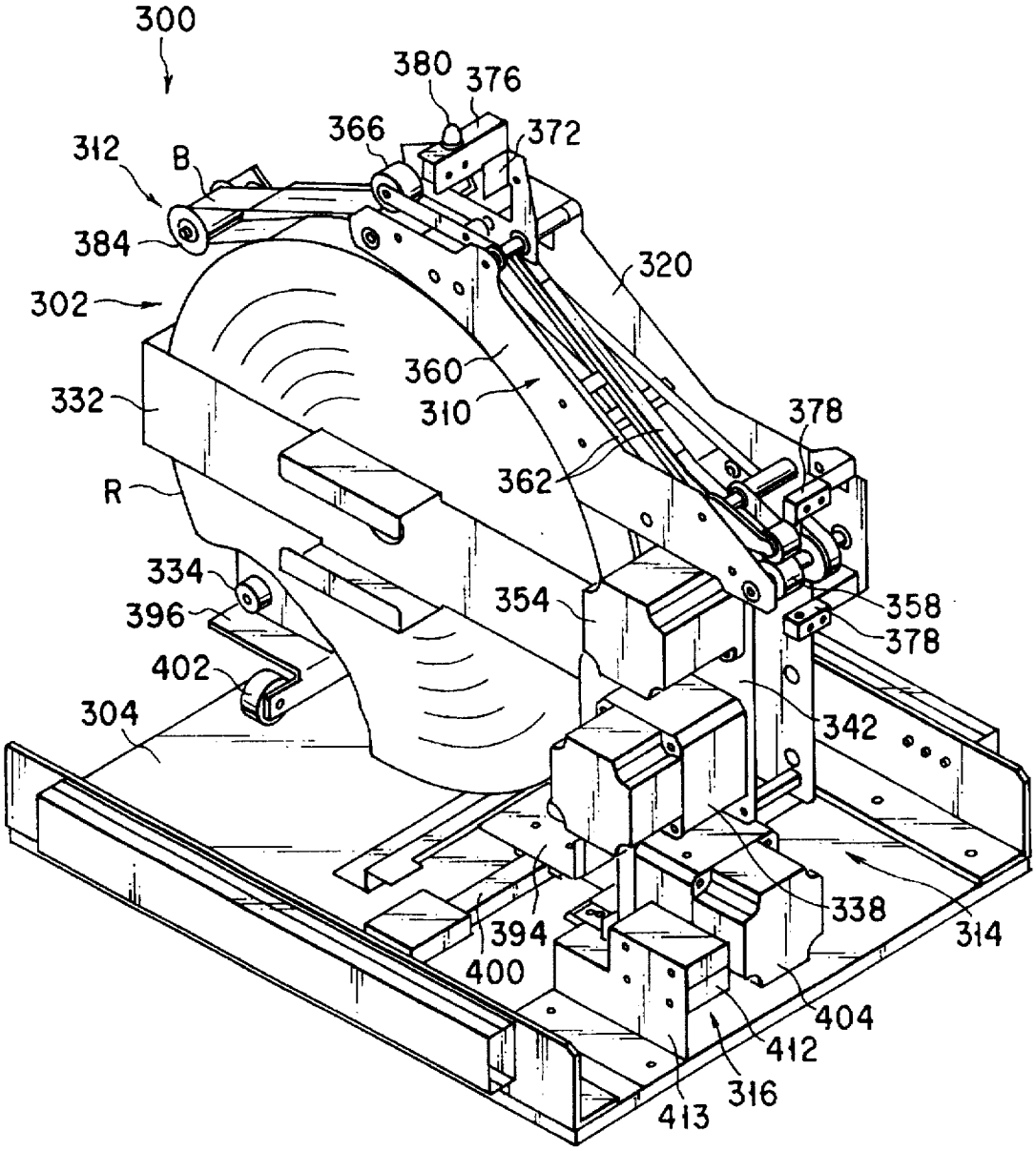
Figure 21:
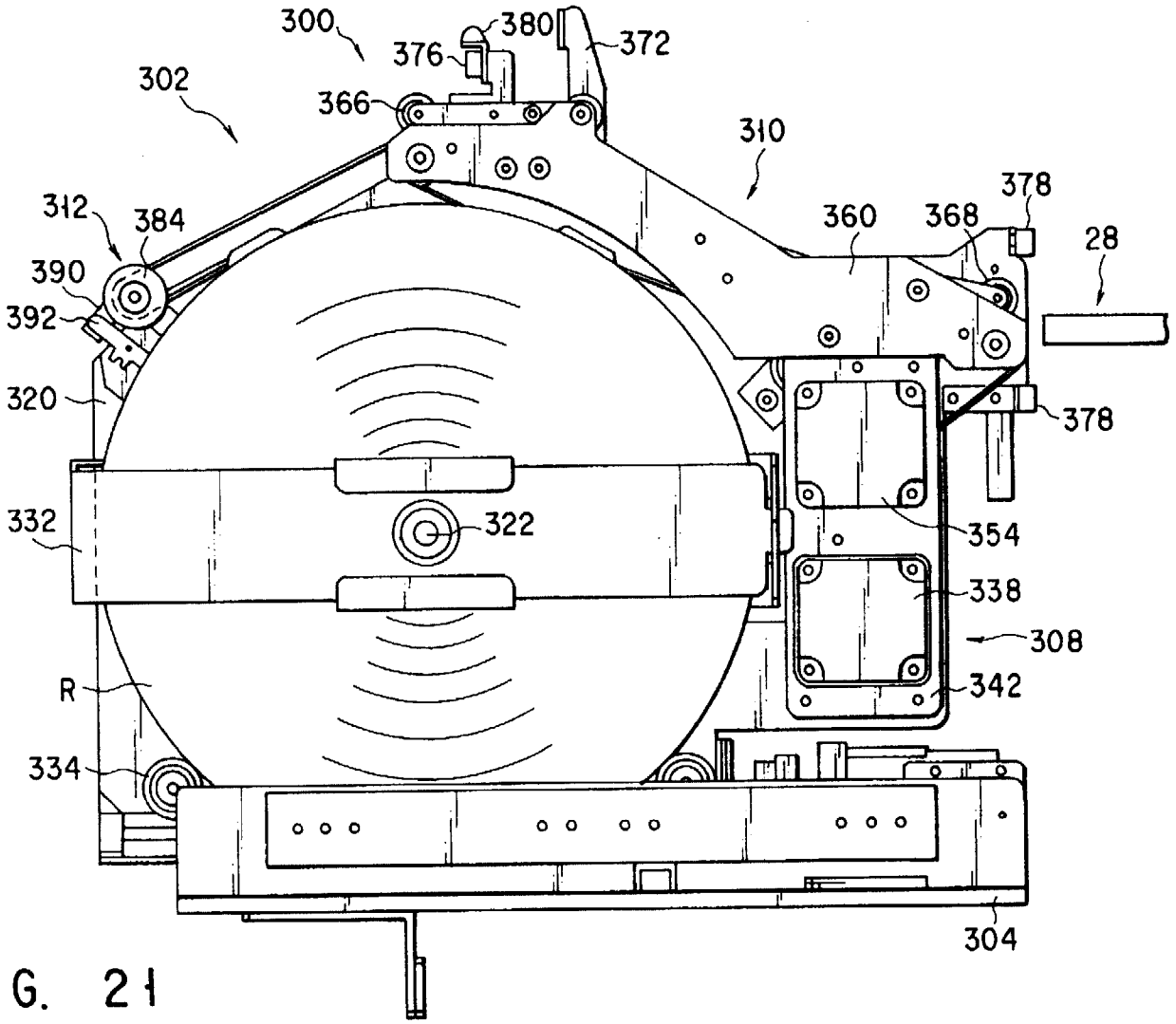

When the discharging plate 150 further advances after the aforesaid binding release operation is finished, its discharging claws 155 abut and press against and the rear end face of the bunch A, as shown in FIG. 19. As the plate 150 moves to the discharging position, the bunch A, along with the band B, is pushed out in the −20° direction and discharged from over the stacking plate 26. The standby position of the discharging plate 150 and its movement to the discharging position are detected by means of first and second discharge sensors 222*a* and 222*b*.

Thus, the binding release process is carried out before the discharging claws 155 of the discharging plate 150 engage the rear end of the bunch A, so that the bunch is unbound when it is to be forced out. Accordingly, the bunch A can be securely discharged tied with the band B without leaving the band alone on the sweeper 56.

After the discharging plate 150 is kept on standby in the discharging position for a given period of time, it is returned to the standby position when a signal is inputted to the effect that the tied bunch A is received by a bunch transportation device in the next stage. After the plate 150 returns to the standby position, the sweeper 56 is returned to the open position, and correspondingly, the stacking plate 26 is also returned to the stacking position. Thereupon, the bundling operation is finished.

On the other hand, the band supply device 300 for supplying the band B to the delivery device 28 is mounted on the support frame (not shown) of the handling apparatus 10 so as to adjoin the back of the device 28.

As shown in FIGS. 20 to 24, the band supply device 300 comprises a band supply section 302, which holds a band roll R formed of a rolled band material and supplies the band B from the roll.

First, an outline of the band supply device 300 will be described in brief. The device 300 comprises a base plate 304 as a base section that is mounted substantially horizontally on the support frame (not shown) of the handling apparatus 10. The band supply section 302 is movable on the base plate 304. By moving the section 302, as mentioned later, the supply device 300 supplies the band B alternatively to the two bunch bundling apparatuses 24*a* and 24*b*.

The band supply section 302 includes a support portion 306 supporting the band roll R for rotation, a roll rotating device 308 as roll rotating means for rotating the band roll R to feed the band B from the outer periphery of the roll, a band feed device 310 as band feed means for feeding the band to a predetermined position, that is, into the band delivery device 28, and a tensioning device 312 as tensioning means for applying a given tension to the fed band.

Further, the band supply device 300 comprises a drive device 314 as drive means and a locking device 316 as locking means for locking the band supply section 302. The drive device 314 causes the section 302 to move between a first position, in which the section 302 faces the band delivery device 28 of the bundling apparatus 24*a*, and a second position, in which the section 302 faces the band delivery device 28 of the bundling apparatus 24*b*.

As shown in FIGS. 20 to 24, the support portion 306 includes a nearly rectangular support plate 320 that is set up substantially at right angles to the base plate 304. A reel shaft 322 is set up virtually in the center of the support plate 320, extending at right angles to the support plate. A disk-shaped reel core 324 is rotatably mounted on the reel shaft 322.

The reel core 324 is fitted with three leaf springs 325 extending along its outer peripheral surface. The band roll R is formed by winding the band B around a cylindrical core 326 (see FIG. 25) made of corrugated board, and is removably mounted on the reel core 324 by fitting its core 326 on the reel core 324. In this case, the leaf springs 325 are elastically in contact with the inner peripheral surface of the core 326, so that the band roll R is securely held on the reel core 324.

A star-shaped roll guide 328 and a driven pulley 330 are arranged between the reel core 324 and the support plate 320 and fixed to the core 324. The inner surface of the band roll R on the core 324 is in contact with the roll guide 328, whereby the band B is prevented from being dislocated. The outer surface of the roll R is guided by an outside guide 332, which is removably attached to the support plate 320 in a manner such that it spans the roll. Below the reel core 324, moreover, a pair of guide rollers 334 are rotatably mounted on the plate 320, and are in contact with the outer peripheral surface of the band roll R.

In this manner, the band roll R is rotatably supported by the support plate 320, and its axis of rotation is parallel to the base plate 304, that is, substantially horizontal. The overall length of the rolled band in the roll R is adjusted to the quantity of band material used during an estimated daily operating time for the bunch bundling apparatuses 24*a* and 24*b*.

A roll rotating device 308 for rotating the band roll R comprises a driving pulley 336 rotatably mounted on the support plate 320, a roll driving motor 338 for rotating the driving pulley, and a timing belt 340 passed around and between the driving pulley 336 and a driven pulley 330 on the reel core 324.

The roll driving motor 338 is fixed on a motor fixing plate 342 that is attached to the support plate 320. The motor 338 is driven at a fixed rotating speed with a predetermined timing under the control of a control unit (mentioned later). Thus, the band roll R, along with the reel core 324, is rotated at a fixed speed by means of the driving pulley 336, timing belt 340, and driven pulley 330. As the roll R rotates in this manner, the band B is delivered from its outer periphery.

The band feed device 310 comprises a driving pulley 344 rotatably mounted on the support plate 320, first and second driven pulleys 346 and 348, a tension pulley 350, a timing belt 352 passed around and between these pulleys, and a band feed motor 354 for rotating the driving pulley 344.

The first driven pulley 346 is located over the band roll R, while the second driven pulley 348 is mounted on the upper portion of the front side of the support plate 320. First and second feed rollers 356 and 358 are connected to the first and second driven pulleys 346 and 348, respectively, for integral rotation. As the driving pulley 344 is rotated by the band feed motor 354, the feed rollers 356 and 358 are synchronously rotated at the same speed by means of the timing belt 352 and the driven pulleys 346 and 348.

Further, the band feed device 310 comprises an elongate guide retaining plate 360, which is attached to the support plate 320 in parallel relation so that the two plates face each other with a given space between them. The first and second feed rollers 356 and 358 are supported between the retaining plate 360 and the support plate 320.

The guide retaining plate 360 is fitted with a pair of parallel band guides 362, which extend from the first feed roller 356 to the second feed roller 358. These band guides 362 face each other with a given space between them, and are formed each having a groove 364 in which each corresponding side edge portion of the band B is fitted.

Arranged between the support plate 320 and the guide retaining plate 360 are first and second presser rollers 366 and 368, which are in rolling contact with the first and second feed rollers 356 and 358, respectively. The first presser roller 366 is supported by a rocking arm 370, which is rockably supported between the plates 320 and 360, and is pressed against the first feed roller 356 by means of a spring (not shown) anchored to the arm 370. A switch lever 372 extends upward from the rocking arm 370. The first presser roller 366 can be separated from the first feed roller 356 by pushing the lever 372.

Likewise, the second presser roller 368 is supported by a rocking arm 374, which is rockably supported between the support plate 320 and the guide retaining plate 360, and is pressed against the second feed roller 358 by means of a spring (not shown) anchored to the arm 374.

When the first and second feed rollers 356 and 358 are rotated, therefore, the band B delivered from the band roll R is fed forward in a manner such that it is held between the first feed roller 356 and the first presser roller 366, and is guided to the second feed roller 358 by the band guides 362. Thereafter, the band B is fed toward the band delivery device 28 in a manner such that it is held between the second feed roller 358 and the second presser roller 368.

First and second band sensors 376 and 378 of the optical transmission type for detecting the passage of the band B are arranged individually in front of the first and second feed rollers 356 and 358, that is, on the delivery side, and are separately supported by the support plate 320. An LED 380 for use as an indicator is provided in the vicinity of the first band sensor 376. The LED 380 glows to inform an operator of the presence of the band B when the first band sensor 376 is dark, that is, when the band is detected.

The tensioning device 312 is provided with a tension arm 382 that is rotatably supported on the reel shaft 322. The arm 382 extends radially outward beyond the outer peripheral edge of the band roll R from the reel shaft. A tension roller 384 is rotatably mounted on the distal end portion of the arm 382. First and second stoppers 386 and 387 are fixed spaced on the support plate 320 so that the tension arm 382 can rock between these stoppers.

Figure 25:
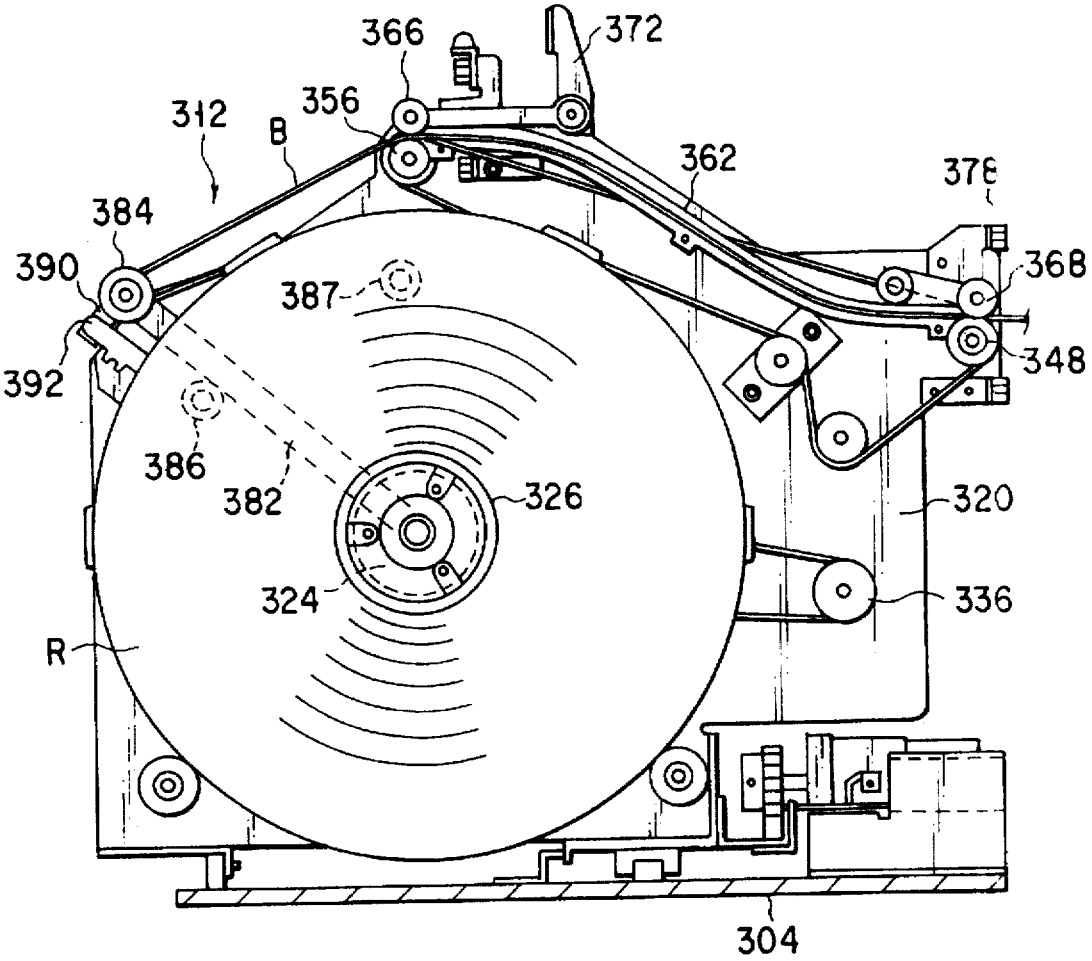

A tension spring 388 is stretched between the tension arm 382 and the support plate 320. The arm 382 is urged in the counterclockwise direction of FIG. 24 by the spring 388, so that it is held in its standby position where it abuts against the first stopper 386. As shown in FIG. 25, the tension roller 384 engages the band B between the band roll R and the first feed roller 356, thereby applying the given tension to the band. In order to prevent the tension arm 382 from springing back, the first and second stoppers 386 and 387 have an outer surface formed of an elastic material such as rubber.

A detection lug 390 protrudes from the extending end of the tension arm 382. Also, an arm sensor 392 of the optical transmission type, for use as a detector, is attached to the support plate 320. The sensor 392 detects the lug 390 when the tension roller 384 and the arm 382 are in their respective standby positions. The arm sensor 392, detection lug 390, and control unit (mentioned later) constitute detecting means according to the present invention.

The lower end of the distal end portion of the support plate 320 of the band supply section 302 constructed in this manner is fixed to a movable plate 394 that extends parallel to the base plate 304, while the lower end of the rear end portion thereof is fixed to a connecting plate 396 that also extends parallel to the base plate 304.

A slider 398 is fixed the lower surface of the movable plate 394. This slider is slidably fitted on a guide rail 400 that is laid on the base plate 304. Further, the connecting plate 396 is fitted with a pair of support rollers 402 (only one of which is shown) that roll on the base plate 304. Thus, the band supply section 302 is supported so as to be movable on the plate 304 in the extending direction of the guide rail 400, especially in the axial direction of the band roll R.

The drive device 314 for moving the band supply section 302 includes a moving motor 404 set on the base plate 304, a pinion gear 405 mounted on the drive shaft of the motor 404, and a rack 406 fixed to the movable plate 394. This rack 406 extends parallel to the guide rail 400 and is in mesh with the gear 405.

First and second position sensors **408*a* and 408*b* are arranged spaced on the path of transfer of the movable plate 394 over the base plate 304. Further, first and second detection plates 410*a* and 410*b* are attached individually to the opposite end portions of the plate 394** in the moving direction thereof.

Figure 22:
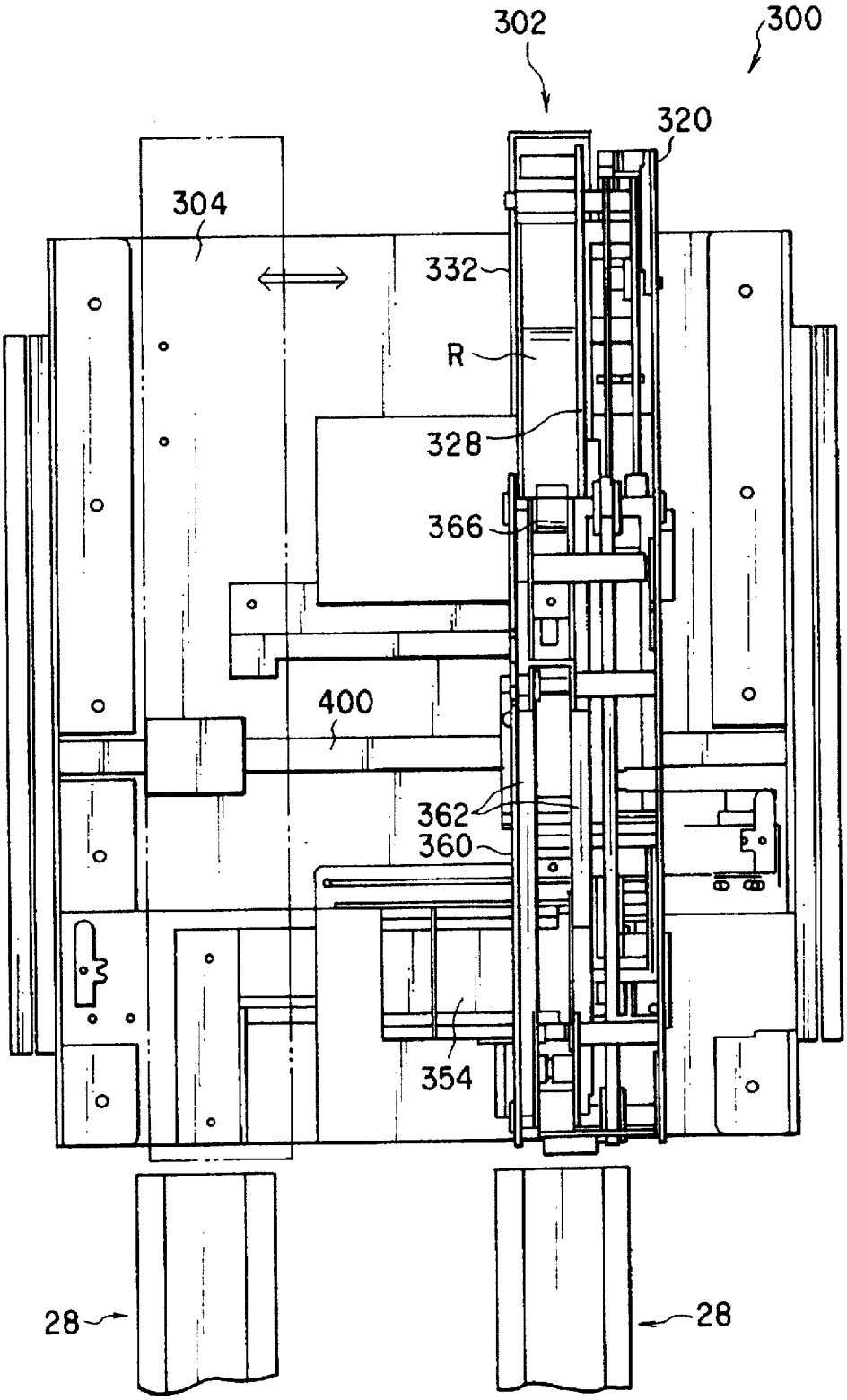
Figure 23:
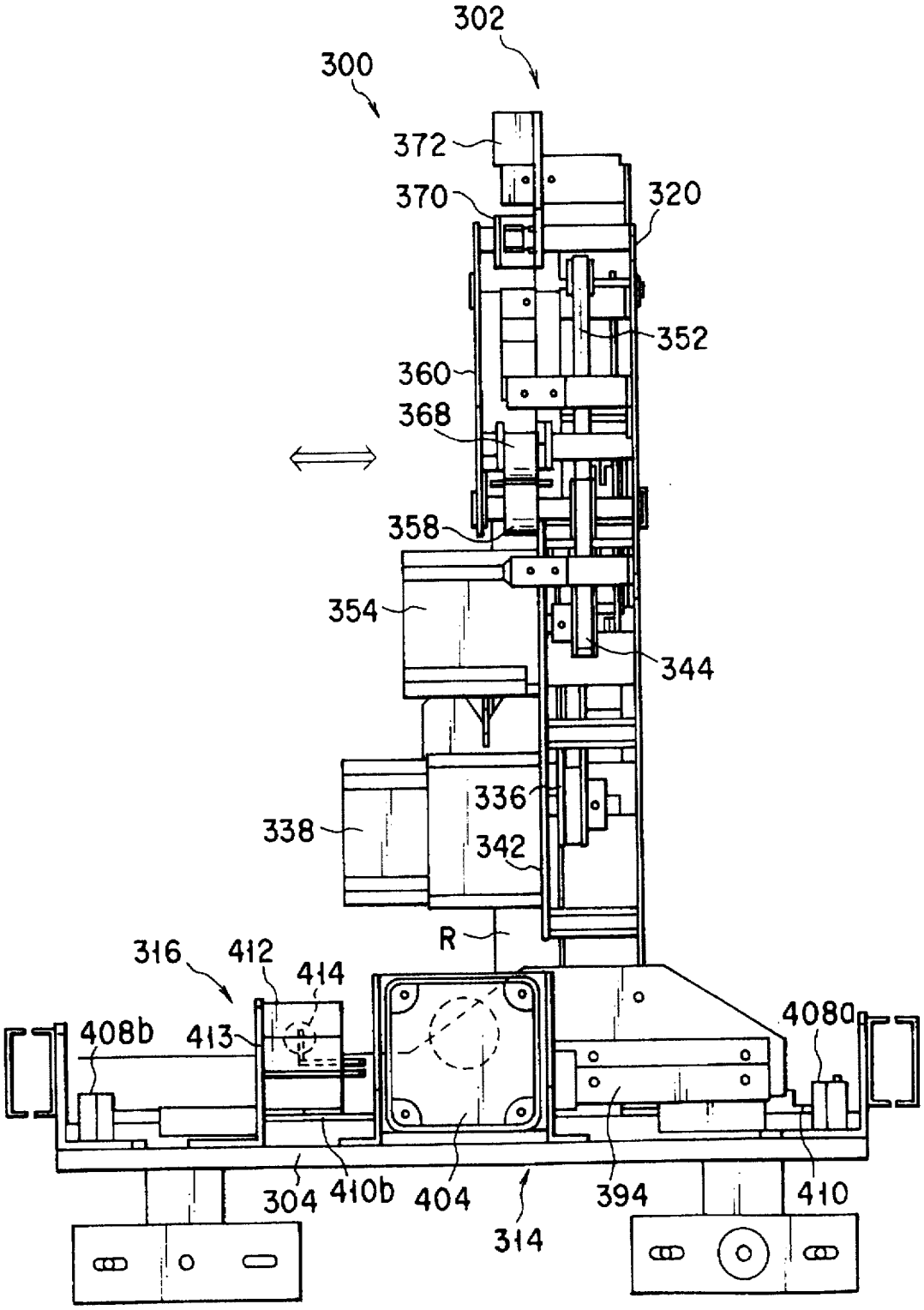
Figure 24:
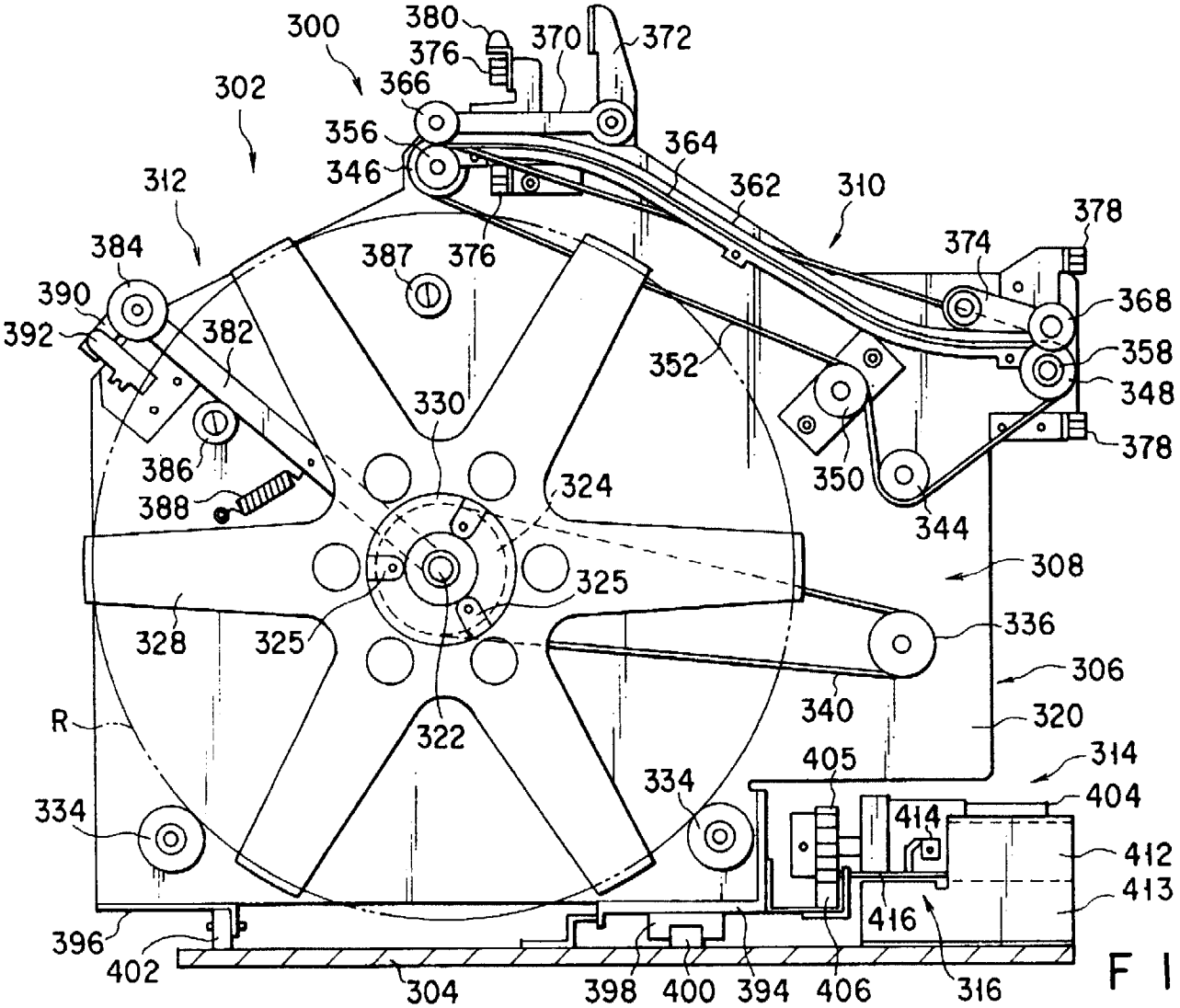

When the moving motor 404 is actuated, the band supply section 302 is moved between the first position indicated by full lines in FIGS. 22 and 23, in which it faces the band delivery device 28 of the bunch bundling apparatus **24*a*, and the second position indicated by two-dot chain lines in FIG. 22, in which the section 302 faces the band delivery device 28 of the bunch bundling apparatus 24*b*. Thus, the band supply device 300 can supply the band B alternatively to the bunch bundling apparatuses 24*a* and 24*b***.

When the band supply section 302 is moved to the first position, the first detection plate **410*a* is detected by the first position sensor 408*a*, and the moving motor 404 is stopped. When the section 302 is moved to the second position, the second detection plate 410*b* is detected by the second position sensor 408*b*, and the motor 404** is stopped.

The locking device 316 for locking the band supply section 302 in the first or second position is provided with a solenoid 412, which is secured to a fixed plate 413 set up vertically on the base plate 304. A plunger 414 of the solenoid 412 can reciprocate in a direction perpendicular to the moving direction of the movable plate 394, and is fitted with a locking fixture 416. The fixture 416 can move parallel to the plunger 414, guided by the fixed plate 413.

When the band supply section 302 is in the first position, the plunger 414 projects from the solenoid 412, and the locking fixture 416 abuts against the left-hand end (FIG. 23) of the movable plate 394, thereby restraining the plate 394 from moving. When the section 302 is in the second position, the fixture 416 engages a groove (not shown) in the plate 394, thereby restraining the movement of the plate 394. In replacing the band roll, the solenoid 412 is energized so that the fixture 416, along with the plunger 414, recedes from the path of transfer of the movable plate 394, thereby unlocking the plate 394 and allowing it to move.

Figure 26:
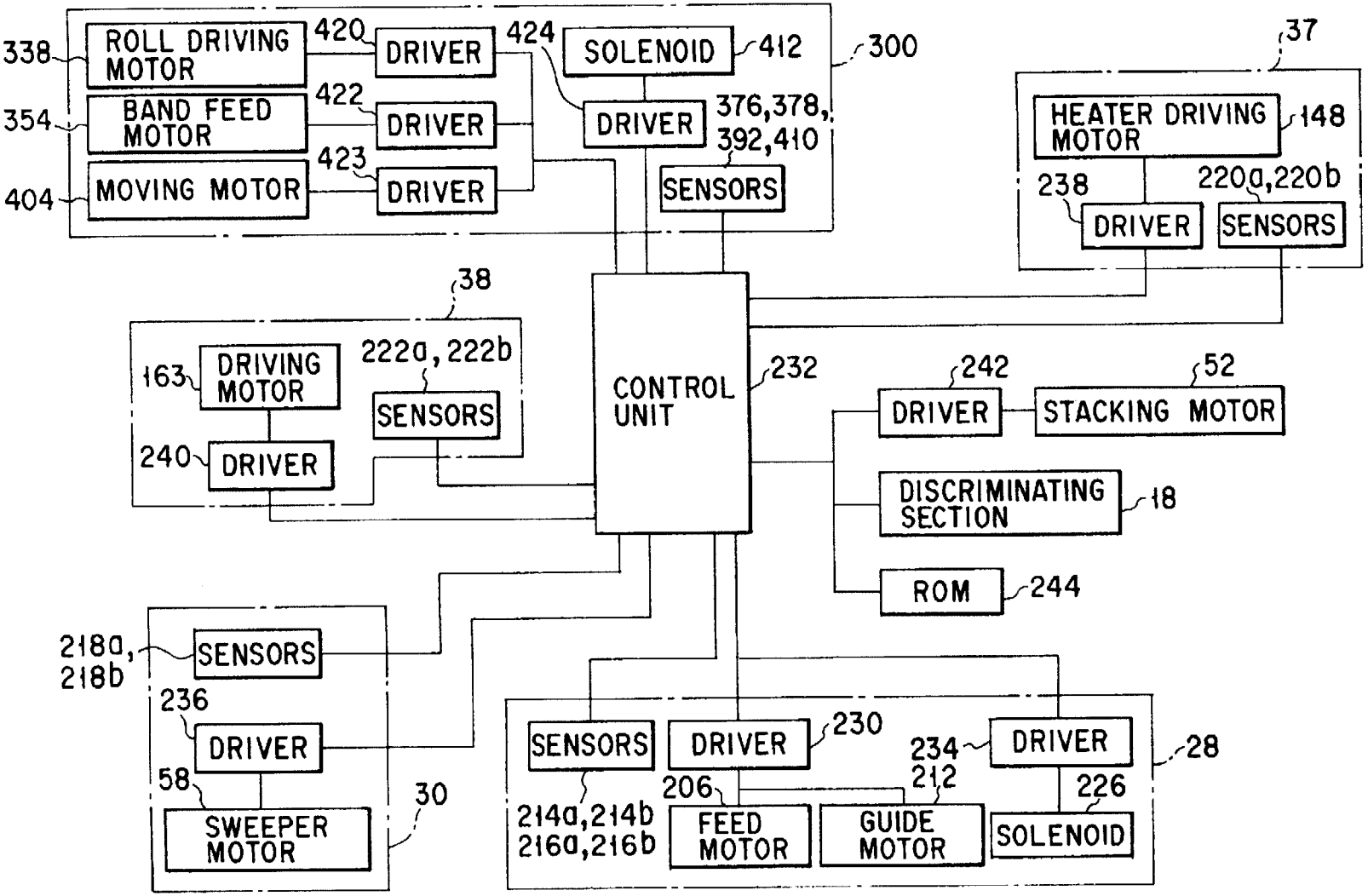

In the bunch bundling apparatus **24*a* constructed in this manner, as shown in FIG. 26, the feed motor 206 and the guide motor 212 of the delivery device 28 are connected to a control unit 232 through a driver 230, and the solenoid 226 for driving the cutter 49 is connected to the unit 232 through a driver 234. Detection signals from the first and second guide sensors 214*a* and 214*b* and the first and second band sensors 216*a* and 216*b* are applied to the input of the control unit 232**.

The sweeper motor 58 of the sweeper device 30 is connected to the control unit 232 through a driver 236, and detection signals from the first and second sweeper sensors 218*a* and 218*b* are applied to the input of the unit 232.

The heater driving motor 148 of the thermocompression bonding device 37 is connected to the control unit 232 through a driver 238, and detection signals from first and second heater sensors 220*a* and 220*b* are applied to the input of the unit 232. Likewise, the driving motor 163 of the bunch discharging device 38 is connected to the control unit 232 through a driver 240, and detection signals from the first and second discharge sensors 222*a* and 222*b* are applied to the input of the unit 232. The stacking motor 52 of the stacking device 27 is connected to the control unit 232 through a driver 242.

The roll driving motor 338 of the band supply device 300 is connected to the control unit 232 through a driver 420. Also, the band feed motor 354 and the moving motor 404 are connected to the unit 232 through drivers 422 and 423, respectively. Further, the solenoid 412 of the locking device 316 is connected to the unit 232 through a driver 424.

The various sensors, including the first and second band sensors 376 and 378, arm sensor 392, and first and second position sensors 408*a* and 408*b*, are connected to the control unit 232, and their detection signals are supplied to the unit 232.

Furthermore, the control unit 232 is connected with the discriminating section 18 of the handling apparatus and a ROM 244 that is stored with various control data. In response to these control data and detection signals from the various sensors, the unit 232 controls the operation of the whole bunch bundling apparatus. The control unit 232 also functions as measuring means and discriminating means according to the present invention.

The following is a description of the operations of the bunch bundling apparatus 24*a* and the band supply device 300 constructed in the aforesaid manner. First, the operation of the supply device 300 will be described in detail.

In loading the band supply device 300 with the band roll or setting the band roll R in the band supply section 302, for example, the handling apparatus 10 is uncovered, and the outside guide 332 is detached from the support plate 320. In this state, the used band roll is removed from the reel core 324, and a new band roll R is fitted on the core 324 instead. Thereafter, the guide 332 is mounted in position. Then, the band B is drawn out nearly to the first feed roller 356 from the outer periphery of the band roll R, and passed around the tension roller 384. Further, the switch lever 372 is pushed to separate the presser roller 366 from the feed roller 356, and the leading end portion of the band B is inserted into the space between the rollers 366 and 356 so that the LED 380 glows with the band detected by the first band sensor 376.

Thereafter, the switch lever 372 is released, and the handling apparatus 10 is covered. As a result, the first and second feed rollers 356 and 358 are rotated by the band feed motor 354 so that the leading end portion of the band B is detected by the second band sensor 378, and the band is automatically fed along the band guides 362 to the second feed roller. Thereupon, the band roll loading is finished.

Figure 27A:
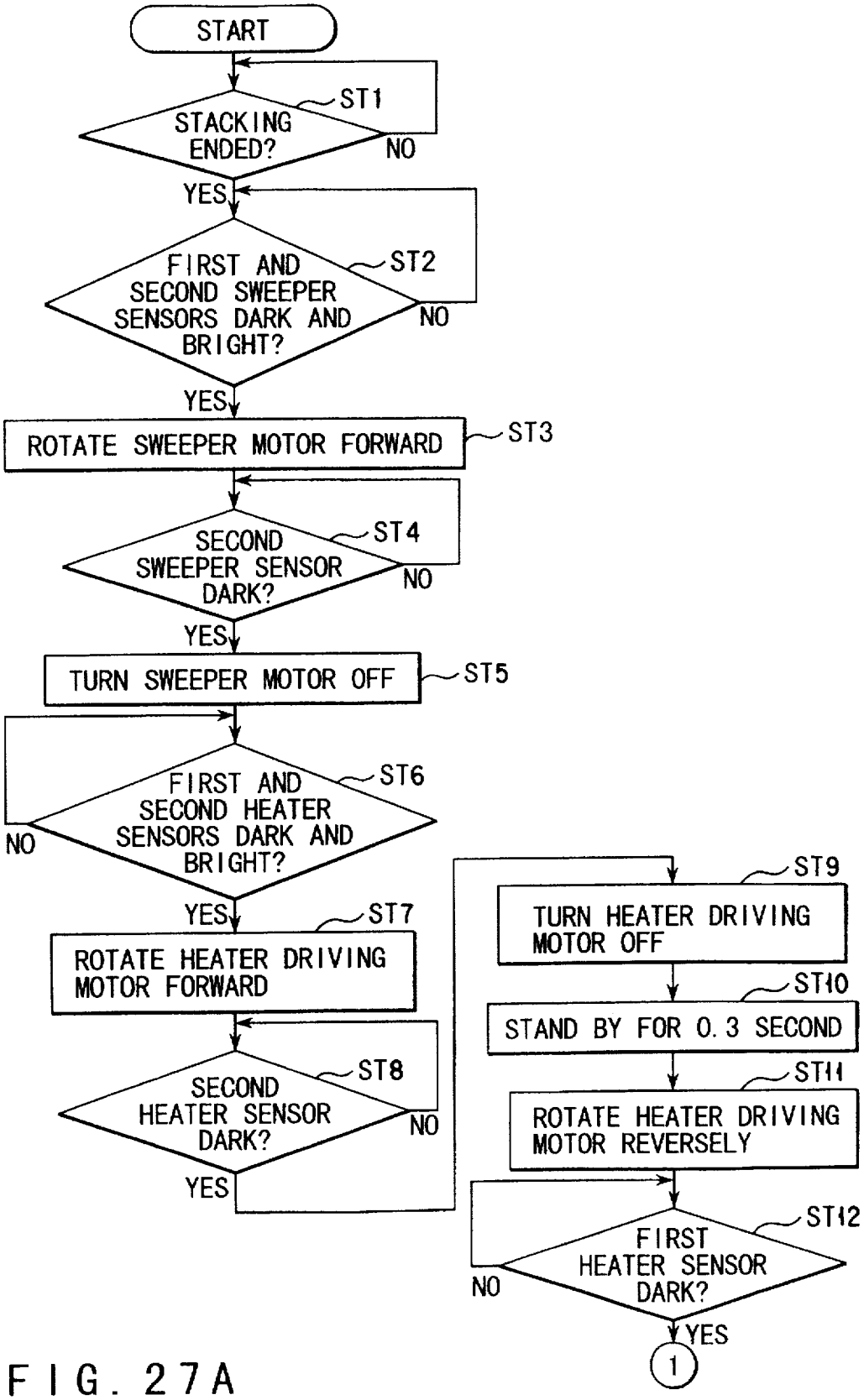
FIGS. 27A and 27B are a flowchart showing the bundling operation of the bundling apparatus.
Figure 27B:
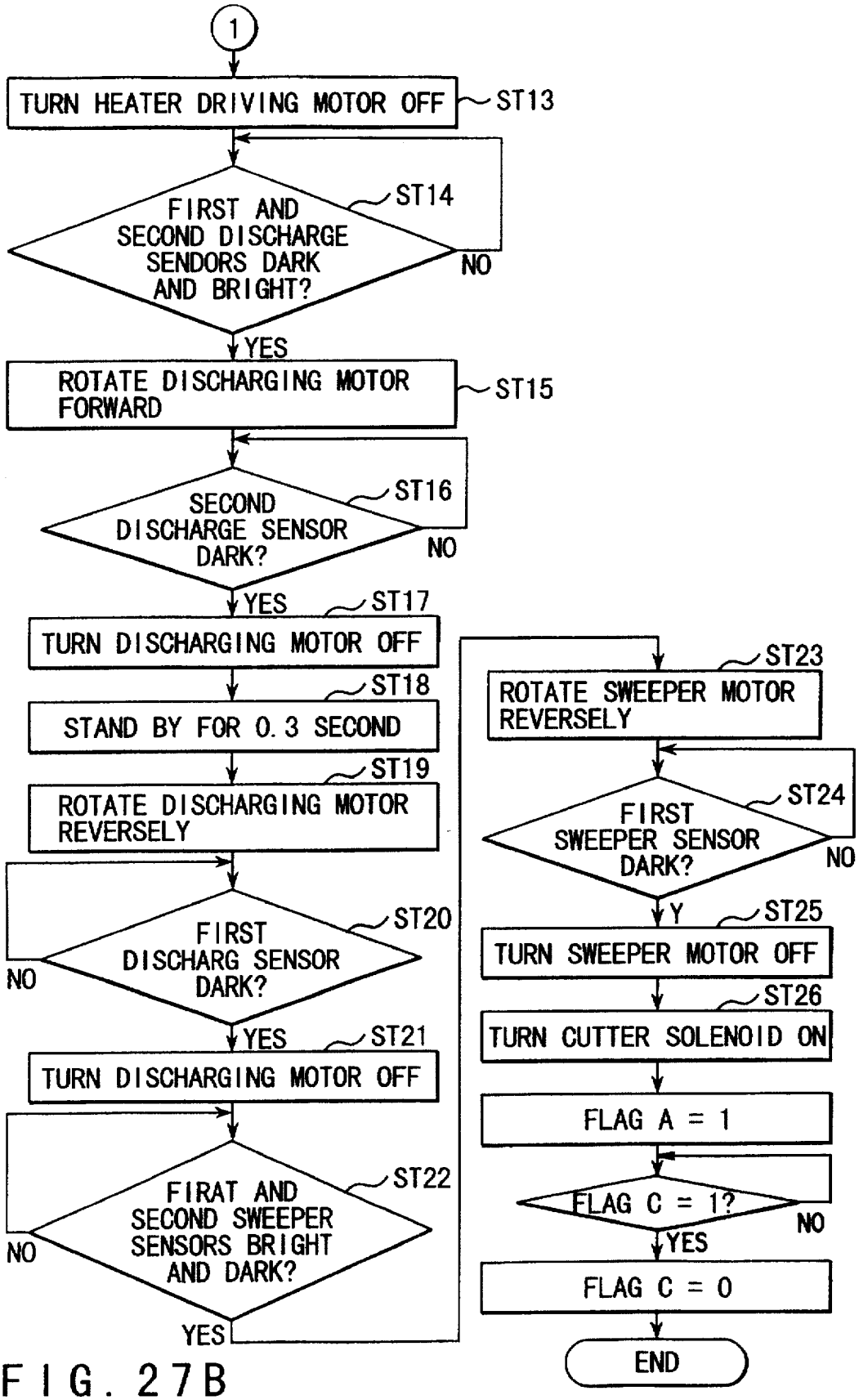

Referring now to the flowcharts of FIGS. 27 and 28 and the timing chart of FIG. 29, the bundling operation of the bunch bundling apparatus and the band supply operation of the band supply device will be described.

First, a predetermined number of securities, for example, are stacked in layers on the stacking plate 26 of the bunch bundling apparatus 24*a*. In doing this, the band B, in the form of a cut strip of a given length, is held on the plate 26, and the securities are stacked on the band. As shown in FIG. 27, when a signal indicative of the termination of stacking of the given number of securities is supplied from the discriminating section 18 of the handling apparatus 10 to the control unit 232 (Step 1), it is detected that the sweeper 56 is in its standby position based on the detection signals from the first and second sweeper sensors 218*a* and 218*b* (Step 2). Thereafter, the sweeper motor 58 of the sweeper device 30 is driven forward (Step 3), so that the sweeper 56 is rotated from its standby position to the bundling position.

When the sweeper 56 reaches the bundling position and is detected by the second sweeper sensor 218*b* (Step 4), the sweeper motor 58 is stopped (Step 5). Then, it is detected that the movable heater 122 is in its standby position based on the detection signals from the first and second heater sensors 220*a* and 220*b* (Step 6), and the heater driving motor 148 of the thermocompression bonding device 37 is driven forward (Step 7). Thus, the movable heater 122 is moved from its standby position to the contact-bonding position. When the movable heater 122 is moved to the bonding position and detected by the second heater sensor 220*b* (Step 8), the heater driving motor 148 is stopped (Step 9). Accordingly, the band B is wound around the bunch in position and subjected to thermocompression bonding. After a predetermined time of standing by (Step 10), the driving motor 148 is driven reversely standby position.

When it is detected that the movable heater 122 is returned to the standby position based on the detection signal from the first heater sensor 220*a* (Step 12, the heater driving motor 148 is stopped (Step 13).

Subsequently, when it is detected that the discharging plate 150 is in its standby position in accordance with the detection signals from the first and second discharge sensors 222*a*, 222*b* (Step 15), the driving motor 163 of the bunch discharging device 38 is driven forward (Step 15), so that the discharging plate 150 is moved from its standby position to the discharging position, and the tied bunch is discharged from over the stacking plate 26. When the discharging plate 150 is moved to the discharging position and detected by the second discharge sensor 222*b* (Step 16), the driving motor 163 is stopped (Step 17). After a predetermined time of standing by (Step 18), the motor 163 is driven reversely (Step 19), so that the discharging plate 150 is returned to the standby position. When the discharging plate 150 is detected by the first discharge sensor 222*a* (Step 20), the driving motor 163 is stopped (Step 21).

The moment the plate 150 returns to the standby position, it is detected that the sweeper 56 is in bundling position based on the detection signals from the first and second sweeper sensors 218*a*, 218*b* (Step 22), and the sweeper motor 58 is driven reversely (Step 23), so that the sweeper 56 is returned from the bundling position to its standby position. After the sweeper 56 is detected by the first sweeper sensor 218*a* (Step 24), the sweeper motor 58 is stopped (Step 25). Thereafter, as described later, the band B is delivered onto the stacking plate 26 by a predetermined length from the band supply device 300 and its rear end is cut by the cutter 49 by the operation of the solenoid 226 (Step 26). Thus, the bundling operation for the securities is finished.

On the other hand, the band supply operation of the band supply device 300 is carried out perfectly in synchronism with the operation of the band delivery devices 28 of the bunch bundling apparatuses 24*a* and 24*b*.

Figure 28A:
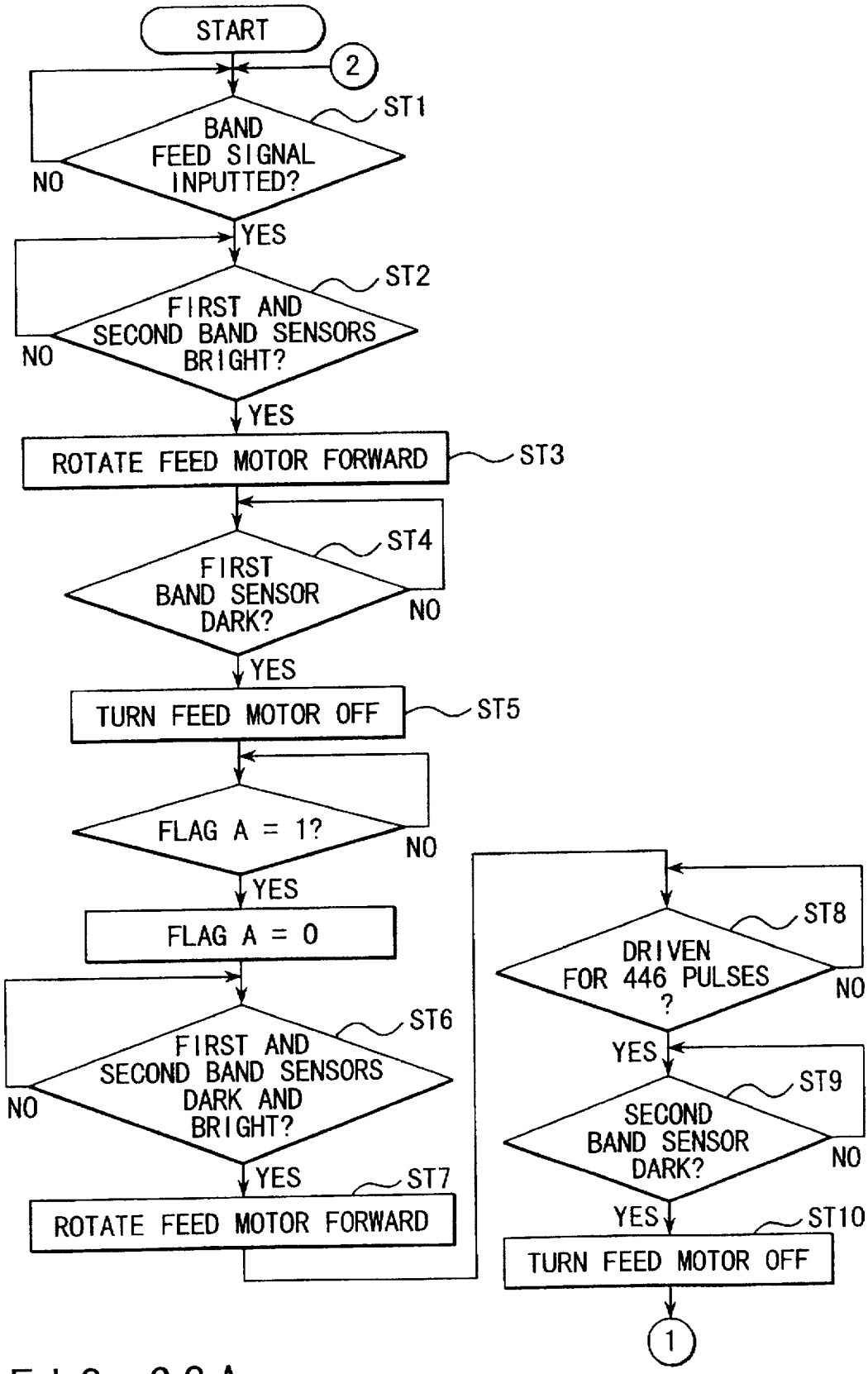
FIGS. 28A and 28B are a flowchart showing the band supply operation of the band supply device.
Figure 28B:
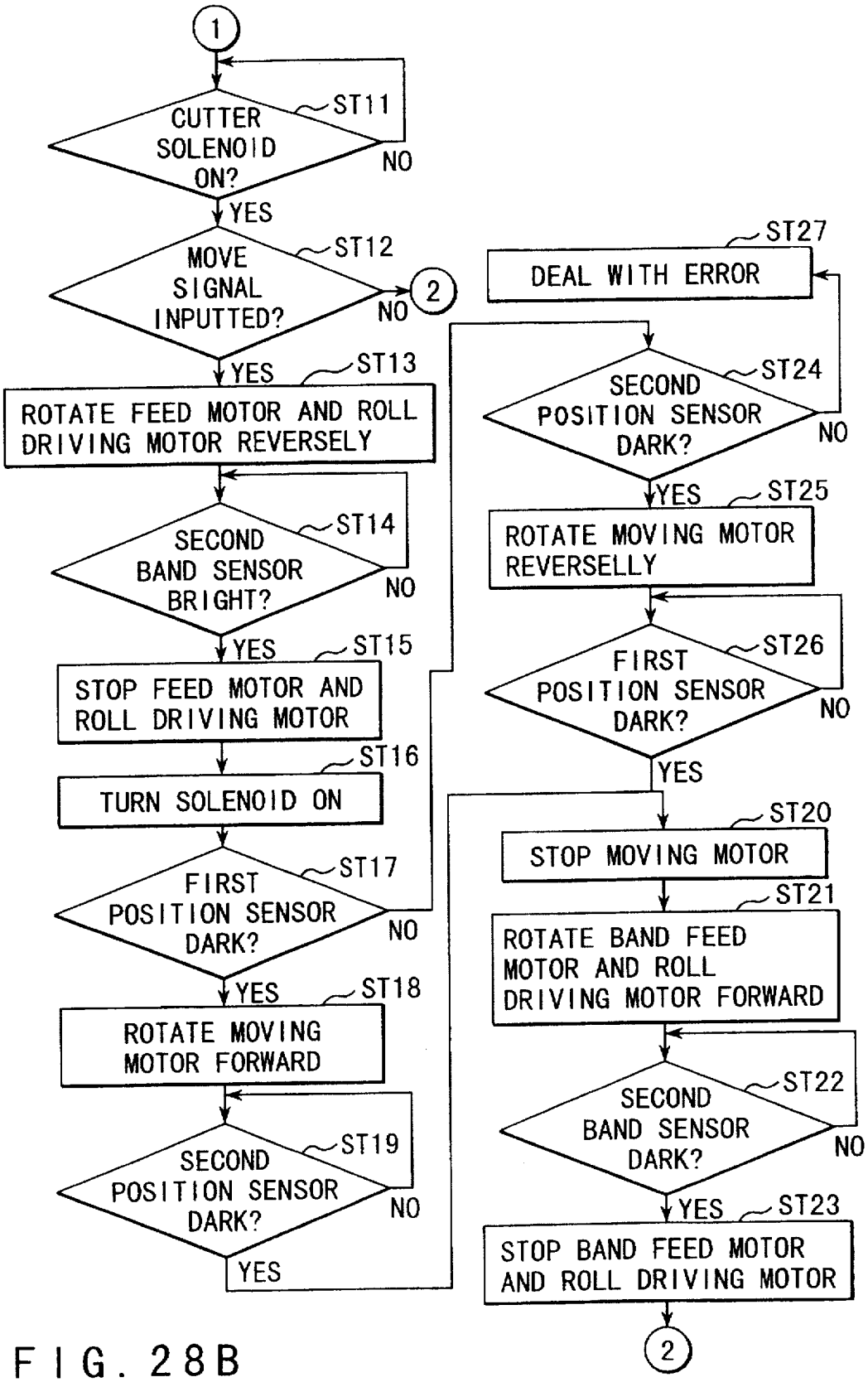
Figure 29:
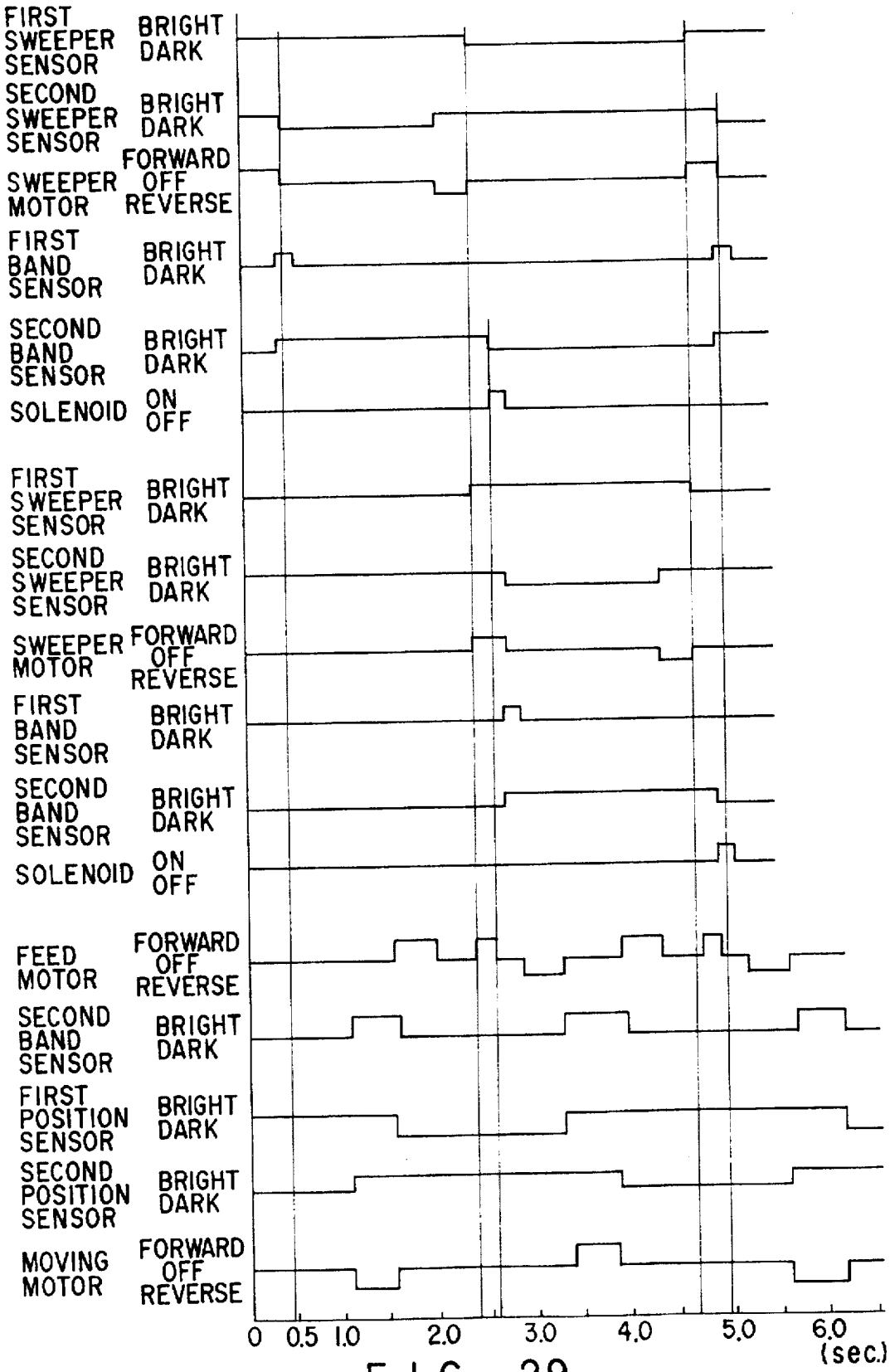

When a band feed signal is first supplied from the control device 232 with the band supply section 302 in the first position and with the sweeper 56 moved from the standby position to the bundling position for the aforesaid bundling operation (Step 1), as shown in FIGS. 28 and 29, it is detected that the band B is not supplied in accordance with the detection signals from the first and second band sensors 216*a*, 216*b* (Step 2) and then the band feed motor 354 of the supply section 302 and the feed motor 206 of the band delivery device 28 are driven forward at predetermined speeds for a given period of time (Step 3). Thereupon, the band B is fed for a given distance or length from the delivery device 28, and the feed motors 354 and 206 are stopped when the leading end of the band is detected by the first band sensor 216*a* (Steps 4 and 5).

When the sweeper 56 is returned to its standby position after the bunch is tied and discharged, it is detected that the leading end of the band B is in that position wherein it faces the first band sensor 216*a* in accordance with the detection signals from the first and second band sensors 216*a*, 216*b* (Step 6). Thereafter, the band feed motor 354 and the feed motor 206 are driven for a predetermined number of pulses to deliver the band B (Steps 7 and 8), and are stopped when the leading end of the band is detected by the second band sensor 216*b* (Steps 9 and 10).

The moment the band B is detected by the sensor 216*b*, the solenoid 226 of the band delivery device 28 is actuated (Step 11), whereupon the trailing end of the band is cut by the cutter 49. After this band supply, the aforementioned stacking and bundling operations are started.

When the band supply to the bunch bundling apparatus 24*a* is finished, on the other hand, the band supply device 300 causes the band supply section 302 to move from the first position to the second position, and supplies the band B to the other bunch bundling apparatus 24*b*.

More specifically, when a move signal is inputted from the control unit 232 (Step 12), the band feed motor 354 and the roll driving motor 338 of the band supply section 302 are driven reversely (Step 13), so that the band B is taken up by the band roll R and drawn out of the band delivery device 28 of the bunch bundling apparatus 24*a*. When the band B is then rewound to the position of the second band sensor 378 of the band supply section 302 and a detection signal is output by the second band sensor 378 (Step 14), the motors 354 and 338 are stopped (Step 15).

Subsequently, the control unit 232 first energizes the solenoid 412 of the locking device 316 to unlock the movable plate 394 (Step 16). If the first position sensor 408*a* is dark (Step 16), that is, if the band supply section 302 is opposed to the band delivery device 28 of the bunch bundling apparatus 24*a*, in this state, the device 232 rotates the moving motor 404 of the drive device 314 forward (Step 17), and stops it when a dark signal is outputted from the second position sensor 408*b* (Steps 19 and 20). As a result, the supply section 302 moves to the second position, and is opposed to the band delivery device 28 of the bunch bundling apparatus 24*b*.

Thereafter, the control unit 232 rotates the band feed motor 354 and the roll driving motor 338 of the band supply section 302 forward (Step 21), thereby delivering the band B, and stops these motors 354 and 338 when the band is detected by the first band sensor 216*a* of the band delivery device 28 of the bunch bundling apparatus 24*b* (Steps 22 and 23).

When the band feed signal is inputted from the control unit 232 in this state, the band B is supplied to the bunch bundling apparatus 24*b* in the same processes as aforesaid. After the band B is fed for the given length, its trailing end portion is cut by the cutter 49 of the band delivery device 28, whereupon the bundling apparatus 24*b* carries out the stacking and bundling operations.

If the band supply section 302 is opposed to the band delivery device 28 of the bunch bundling apparatus 24*b*, that is, if the second position sensor 408*b* is dark (Step 24), when the movement of the supply section 302 is started, the moving motor 404 of the drive device 314 is rotated reversely so that the section 302 is moved to the first position (Step 25). When a dark signal is outputted from the first position sensor 408*a*, the motor 404 is stopped (Steps 26 and 20), so that the band supply section 302 is opposed to the delivery device 28 of the bundling apparatus 24*a*. In case both the first and second position sensors 408*a* and 408*b* are bright, error processing is carried out (Step 27).

By operating in the manner described above, the band supply device 300 supplies the band B alternatively to the two bunch bundling apparatuses 24*a* and 24*b*.

Figure 30:
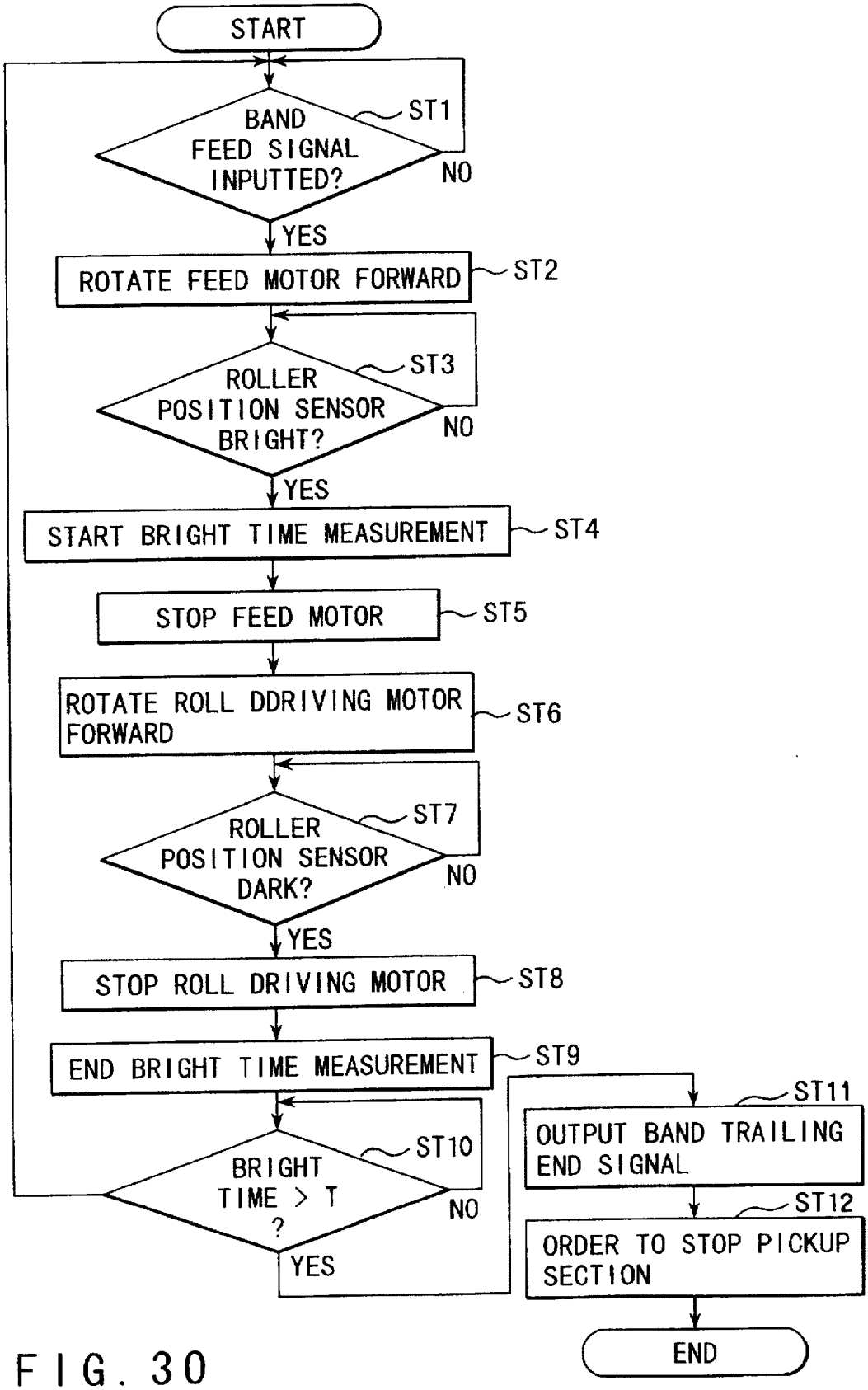
Figure 31:
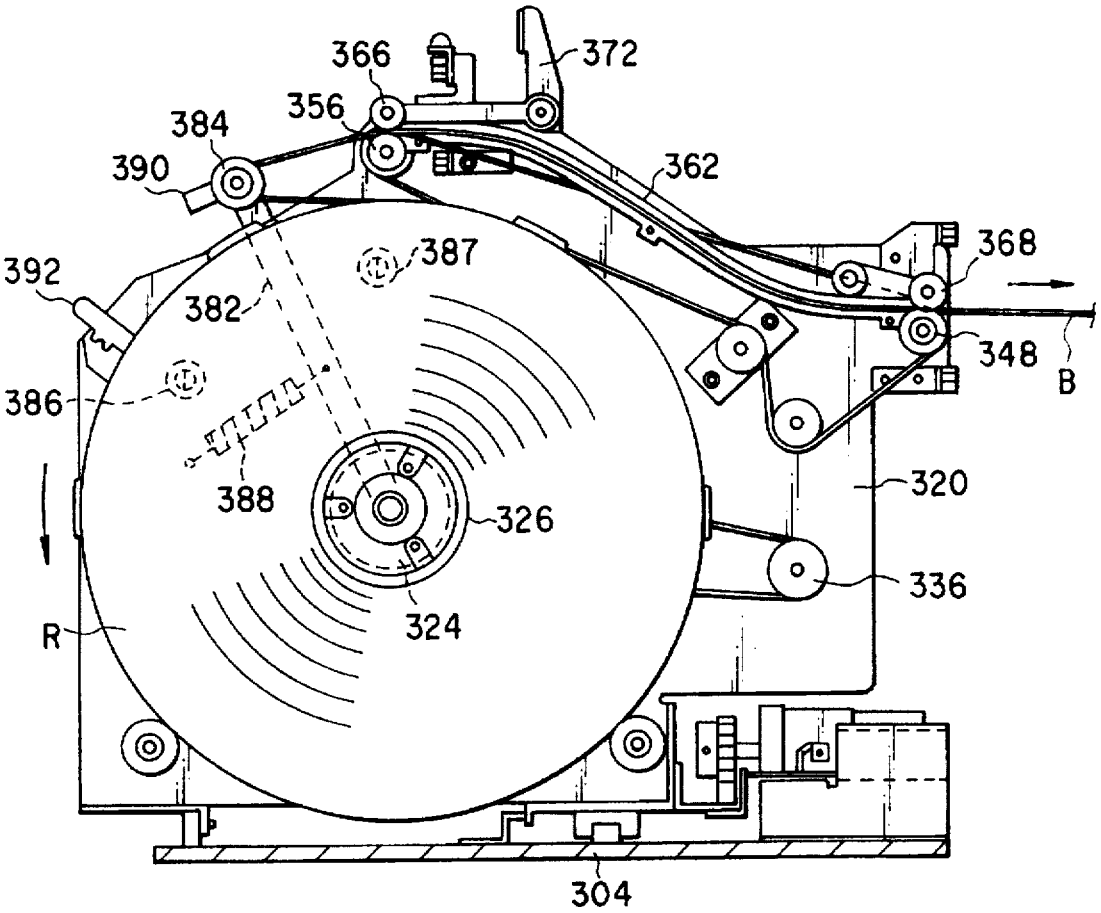
Figure 32:
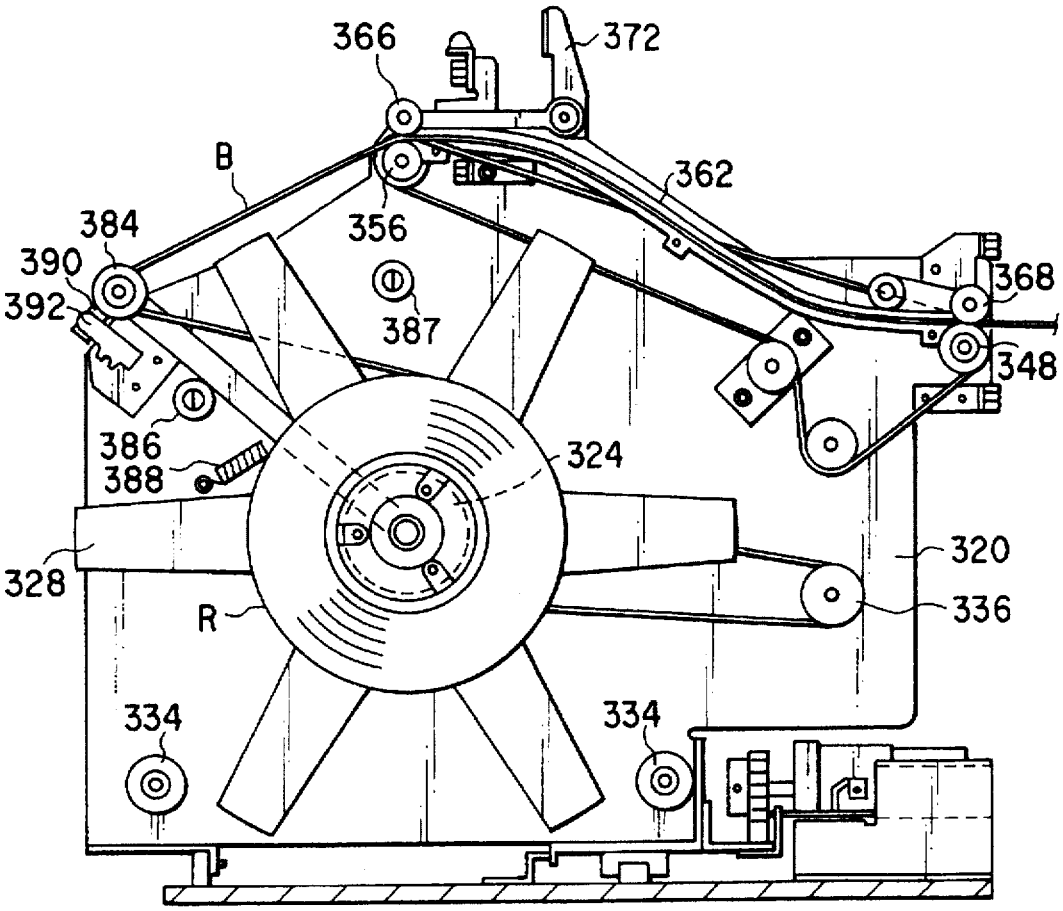

Referring now to FIGS. 30 to 32, the band supply operation and band trailing end detecting operation of the band supply device 300 will be described.

When the band feed signal is inputted from the control unit 232 (Step 1), the band feed motor 354 is rotated forward at a predetermined speed by means of the driver 422 for a given period of time (Step 2). Thereupon, the band B is fed for the given length to the band delivery device 28 by means of the first and second feed rollers 356 and 358. In FIG. 25, the length of the band B extending between the tension roller 384 and the first feed roller 356 in their respective standby positions is substantially equal to the required length for each cycle of bundling operation.

When the band B is fed in the manner shown in FIG. 31, the tension roller 384 is pulled by the band, so that the tension arm 382 rocks clockwise from its standby position, resisting the urging force of the tension spring 388. As a result, the detection lug 390 of the arm 382 is separated from the arm sensor 392, and the sensor 392 outputs a bright signal (ST3).

In response to the bright signal from the arm sensor 392, the control unit 232 starts the measurement of a bright time t (Step 4), stops the drive of the band feed motor 354 (Step 5), and rotates the roll driving motor 338 forward at a fixed speed (Step 6). As a result, the band roll R is rotated counterclockwise at a fixed angular velocity, thereby delivering the band B from its outer periphery. Thereupon, the tension roller 384 and the tension arm 382 are rocked counterclockwise to be returned to their respective standby positions by the tension spring 388.

When the tension arm 382 returns to its standby position, the arm sensor 392 detects the detection lug 390 and outputs a dark signal (Step 7). In response to this dark signal, the control unit 232 stops the roll driving motor 338 (Step 8). In this stopped state, the motor 338 is braked by its own excitation torque.

While carrying out the operation of ST8, the control unit 232 measures the time interval which elapses from the instant that the tension arm 382 leaves its standby position until it returns to the same position, that is, the time t during which the arm sensor 392 is bright, in accordance with the signal from the sensor 392 (Step 9). This bright time t is utilized for the detection of the trailing end portion of the band B wound around the band roll R, that is, the tail end portion of the roll R.

More specifically, the roll driving motor 338 rotates at the fixed angular velocity, so that a band supply speed v can be expressed as follows:

$$v=r\times w,$$

where w and r are the angular velocity of rotation of the motor 338 and the then radius of the band roll R, respectively.

If the required length of the band B for each cycle of bundling operation is L, the time t which elapses from the instant that the tension arm 382 moves clockwise from its standby position until it returns to the same position is given by $$t=L/v=L/(r\cdot w).$$

Since L and w are constant, this equation indicates that although the tension arm 382 returns to the standby position in a short time in the case where the band roll radius r is wide, the time t lengthens in inverse proportion to the roll radius s that decreases as the band B is consumed. Thus, the reduction of the band roll radius r below a predetermined value, that is, the reduction of the band roll residue below a given level or the trailing end of the band roll, is detected when t is t>T by continually measuring the time t by means of the control unit 232 and comparing it to the predetermined time T (Step 10).

Since the predetermined time T can be subdivided freely and set quantitatively, the trailing end portion of the band roll can be detected accurately.

As mentioned before, moreover, the band delivery device 28 delivers the band B in two stages in each cycle of bundling operation. The delivery and delivery rate for a second stage substantially double those for a first stage. Accordingly, the control unit 232 of the band supply device 300 measures the return time t of the tension arm 382 in a band feed stage corresponding to the second band delivery stage. According to the present embodiment, the control unit 232 establishes a starting state for the measurement of the time t with use of a start signal for the second feed stage, and starts the measurement in response to the bright signal from the arm sensor 392. In this manner, wrong trailing end detection is prevented if the tension arm 382 is rocked unexpectedly.

When the trailing end portion of the band roll R is detected, that is, when the reduction of the band roll residue to or below the given level is detected, the control unit 232 outputs a band trailing end signal (Step 11), and stops the operation of the pickup section 14 of the handling apparatus 10 (Step 12).

According to the bundling apparatus constructed in this manner, the bunch A on the stacking plate 26 is moved to the bundling position as the plate 26 is rocked. In contrast with the conventional case, therefore, the bunch need not be transported from the stacking position to the bundling position by using any other mechanism such as a transportation carrier, and the distance of its transportation can be minimized. Thus, the construction of the bundling apparatus can be simplified, and the cycle time can be shortened considerably. Moreover, the number of securities that fall during the movement from the stacking position to the bundling position can be reduced by a large margin, so that the reliability of the apparatus is improved, and sensors or the like for the detection of the falling can be omitted. In consequence, the bundling apparatus can be further simplified in construction.

In the bundling apparatus with the aforementioned construction, furthermore, the bunch A can be bundled securely and firmly with the band B under an increased bundling tension by winding the band around the bunch in a curved state and releasing the bunch from the curvature after it is tied. The curvature release operation is carried out before the discharging claws 155 of the discharging plate 150 engage the rear end of the bunch A, so that the bunch is unbound when it is to be forced out. Accordingly, the bunch A can be securely discharged tied with the band B without leaving the band alone on the stacking plate 26.

The band B is cut after it is delivered for the given length by the band delivery device 28, and is then held in position by the band binding device 36 and the band bending device 34. Thereafter, the cut band B is bent along the bunch A and contact-bonded by the thermocompression bonding device 37. Accordingly, the delivery device 28 need not rewind the band B after delivering it, so that it can be prevented from being damaged or lowered in life performance. Besides, the bunch A can be tied uniformly with the band B, so that the quality of the tied bunch can be improved.

According to the arrangement described above, the band supply device is movable between two bunch bundling apparatuses, so that the band can be supplied alternatively to these bundling apparatuses. Thus, two bunch bundling apparatuses can share one common band supply device, so that the manufacturing cost of the whole apparatus can be reduced.

Further, any person can easily load the band supply device with the band roll by only inserting the leading end portion of the band into the gap between the first feed roller and the first presser roller after mounting the band roll on the reel core. Thus, the band roll can be loaded in a short time without regard to the expertness or skill of the operator, and the work load can be lessened.

According to the band supply device with the aforementioned construction, the diameter of the band roll is measured by utilizing the behavior of the tension arm of the tensioning device, whereby the trailing end portion of each band roll, that is, the band residue, is detected. Thus, the band residue can be detected with higher accuracy than in the conventional case. In consequence, the band can be used accurately to the given residue level, so that its wastage or shortage can be reduced or prevented.

According to the bundling apparatus constructed in the manner described herein, the band used to tie the next lot of securities is delivered close to the stacking position before the bundling operation for the preceding lot of securities is finished. Thus, the band delivery operation can be carried out partially in concert with other handling operations, so that the cycle time for the entire operation can be shortened.

It is to be understood that the present invention is not limited to the embodiment described above, and that various changes and modifications may be effected therein by one skilled in the art without departing from the scope or spirit of the invention. For example, the bundling apparatus and the sheet handling apparatus according to the invention may be also applied to bundling and handling operations for any other sheets than securities.

What is claimed is:

1. A sheet bundling apparatus comprising:

a substantially flat stacking plate rotatable between a substantially horizontal stacking position and a bundling position inclined downward with respect to the stacking position;

band supply means for delivering a band onto the stacking plate in the stacking position;

stacking means for stacking a plurality of sheets in layers on the stacking plate in the stacking position while overlapping with the band delivered by the band supply means onto the stacking plate;

moving means having a plate-like sweeper rotatable between an open position, in which the sweeper is separated from the band supply means and the stacking plate, and a hold position, in which the sweeper is opposed substantially parallel to the stacking plate;

the moving means being for pressing the sheets stacked on the stacking plate to hold the sheets between the sweeper and the stacking plate and for rotating the stacking plate from the stacking position to the bundling position, by rotating the sweeper from the open position to the hold position;

curving means for curving the sheets stacked on the stacking plate which is rotated to the bundling position by the moving means; and bundling means for winding and bundling the curved sheets on the stacking plate rotated to the bundling position with the band.

2. A sheet bundling apparatus according to claim 1, which further comprises discharging means for discharging the sheets bundled with the band from over the stacking plate located at the bundling position in a direction inclined downward with respect to the horizontal direction, after releasing the sheets from the curvature.

3. A sheet bundling apparatus according to claim 2, wherein said moving means includes a first presser member, attached to the sweeper and pressing the central portion of the stacked sheets, and a pair of second presser members attached to the sweeper, situated on either side of the first presser member, and individually pressing the opposite side edge portions of the stacked sheets, the first presser member projecting closer to the stacked sheets than the second presser member.

4. A sheet bundling apparatus according to claim 3, wherein said curving means includes a pair of presser lugs opposed to the second presser member of the sweeper in the hold position and individually pressing the opposite side edge portions of the stacked sheets from the stacking plate side.

5. A sheet bundling apparatus according to claim 1, wherein said bundling means includes band bending means for pressing one end portion of the band, extending from one side of the stacked sheets, against one side face of the sheets, band binding means for binding the other end portion of the band, extending from the other side of the stacked sheets, along the other side face and upper surface of the sheets, and band laying means for laying the one end portion of the band, pressed against the one side face of the sheets, along the upper surface of the sheets so that the one end portion overlaps the other end portion of the band.

6. A sheet bundling apparatus according to claim 5, wherein said bundling means includes thermocompression bonding means for subjecting the overlapping portion of the band to thermocompression bonding.

7. A sheet handling apparatus comprising:

supply means for supplying a plurality of sheets;

pickup means for picking up the sheets one after another from the supply means;

transportation means for transporting the picked-up sheets picked up by the pickup means along a fixed transportation path;

discriminating means arranged along the transportation path, for detecting information from the sheets being transported; and a bundling apparatus for stacking and bundling each predetermined number of sheets discriminated by the discriminating means, the bundling apparatus including:

a substantially flat stacking plate rotatable between a substantially horizontal stacking position and a bundling position inclined downward with respect to the stacking position;

band supply means for delivering a band onto the stacking plate in the stacking position;

stacking means for stacking a plurality of sheets in layers on the stacking plate in the stacking position while overlapping with the band delivered by the band supply means onto the stacking plate;

moving means having a plate-like sweeper rotatable between an open position, in which the sweeper is separated from the band supply means and the stacking plate, and a hold position, in which the sweeper is opposed substantially parallel to the stacking plate;

the moving means being for pressing the sheets stacked on the stacking plate to hold the sheets between the sweeper and the stacking plate and for rotating the stacking plate from the stacking position to the bundling position by rotating the sweeper from the open position to the hold position;

curving means for curving the sheets, moved together with the stacking plate to the bundling position by the moving means, by pushing up side edge portions of the sheets;

bundling means for winding and bundling the sheets on the stacking plate, moved to the bundling position and curved by the curving means, with the band; and discharging means for discharging the sheets bundled with the band from over the stacking plate located at the bundling position in a direction inclined downward with respect to the horizontal direction after releasing the sheets from the curvature.

8. A sheet handling apparatus comprising: first and second bundling apparatuses arranged side by side; and a band supply device for supplying a band alternatively to the first and second bundling apparatuses, each of the first and second bundling apparatuses including:

a stacking plate movable between a stacking position and a bundling position, stacking means for stacking a plurality of sheets in layers on the band supplied from the band supply device and placed on the stacking plate in the stacking position, moving means for moving the stacking plate from the stacking position to the bundling position in a manner such that the sheets and the band stacked on the stacking plate are held between the moving means and the stacking plate, and bundling means for winding and bundling the sheets on the stacking plate moved to the bundling position with the band; and the band supply device including:

a band roll formed by rolling a band, a band roll support portion supporting the band roll for rotation, a base portion supporting the band roll support portion for movement between a first position, in which the band roll faces the first bundling apparatus, and a second position, in which the band roll faces the second bundling apparatus, drive means for moving the band roll support portion between the first and second positions, band feed means provided on the band roll support portion, for drawing out the band from the outer periphery of the band roll and feeding the band to the first or second bundling apparatus, and rotating means provided on the band roll support portion, for rotating the band roll to deliver the band to the band feed means.

9. A sheet handling apparatus according to claim 8, wherein each of said first and second bundling apparatuses includes cutting means for cutting the trailing end of the supplied band when the band is fed for a given length from the band supply device onto the stacking plate.

10. A sheet handling apparatus according to claim 8, wherein said band supply device includes detecting means for detecting the trailing end portion of the band of the band roll and control means for stopping the operations of the band feed means and the roll rotating means when the trailing end portion of the band is detected by the detecting means.

11. A sheet handling apparatus according to claim 10, wherein said band supply device includes tensioning means provided on the band roll support portion, for engaging the corresponding band between the band roll and the band feed means and applying tension to the band.

12. A sheet handling apparatus according to claim 11, wherein said tensioning means includes a tension roller, supported for movement along the outer periphery of the corresponding band roll between a standby position and the band feed means and in engagement with the band, and urging means for urging the tension roller toward the standby position, the tension roller being adapted to be moved from the standby position toward the band feed means by the band in response to feed operation of the band feed means, and to be returned to the standby position by the urging means in response to band delivery operation of the roll rotating means;

said detecting means includes a detector for detecting the tension roller in the standby position; and said control means includes measuring means for measuring the time that elapses from the instant that the tension roller moves from the standby position until the roller returns to the standby position, and discriminating means for discriminating the trailing end portion of the band of the band roll when the measured time attains a predetermined value.

13. A sheet handling apparatus according to claim 8, wherein each of said first and second bundling apparatuses includes curving means for curving the sheets, moved together with the stacking plate to the bundling position, by pushing up opposite side edge portions of the sheets, and said bundling means winds and ties the sheets on the stacking plate, moved to the bundling position and curved, with the band.

14. A sheet handling apparatus according to claim 13, wherein each of said first and second bundling apparatuses includes discharging means for discharging the sheets tied with the band from over the stacking plate after releasing the sheets from the curvature.

15. A sheet handling apparatus according to claim 8, wherein said bundling means includes band bending means for pressing one end portion of the band, extending from one side of the stacked sheets, against one side face of the sheets, band binding means for bending the other end portion of the band, extending from the other side of the stacked sheets, along the other side face and upper surface of the sheets, and band laying means for laying the one end portion of the band, pressed against the one side face of the sheets, along the upper surface of the sheets so that the one end portion overlaps the other end portion of the band.

16. A sheet handling apparatus according to claim 15, wherein said bundling means includes thermocompression bonding means for subjecting the overlapping portion of the band to thermocompression bonding.

17. A sheet bundling apparatus comprising:

a stacking plate rotatable between a substantially horizontal stacking position and a bundling position inclined downward with respect to the stacking position;

band supply means for delivering a band onto the stacking plate in the stacking position;

stacking means for stacking a plurality of sheets in layers on the stacking plate in the stacking position while overlapping with the band delivered by the band supply means onto the stacking plate;

moving means including a plate-like sweeper rotatable between an open position, in which the sweeper is separated from the band supply means and the stacking plate, and a hold position, in which the sweeper is opposed substantially parallel to the stacking plate in the bundling position;

the moving means being for moving the stacking plate from the stacking position to the bundling position in a manner such that the sheets stacked on the stacking plate are held between the sweeper and the stacking plate by rotating the sweeper from the open position to the hold position;

the moving means having a first presser member, attached to the sweeper and pressing the central portion of the stacked sheets, and a pair of second presser members attached to the sweeper, situated on either side of the first presser member, and individually pressing the opposite side edge portions of the stacked sheets, the first presser member projecting closer to the stacked sheets than the second presser member;

curving means for curving the sheets, moved together with the stacking plate to the bundling position, the curving means including a pair of presser lugs opposed to the second presser member of the sweeper in the hold position and individually pressing the opposite side edge portions of the stacked sheets from the stacking plate side;

bundling means for winding and bundling the sheets on the stacking plate, moved to the bundling position and curved, with the band; and discharging means for discharging the sheets bundled with the band from over the stacking plate after releasing the sheets from the curvature.

18. A sheet bundling apparatus comprising:

a stacking plate rotatable between a substantially horizontal stacking position and a bundling position inclined downward with respect to the stacking position;

band supply means for delivering a band onto the stacking plate in the stacking position;

stacking means for stacking plurality of sheets in layers on the stacking plate in the stacking position while overlapping with the band delivered by the band supply means onto the stacking plate;

moving means including a plate-like sweeper rotatable between an open position, in which the sweeper is separated from the band supply means and the stacking plate, and a hold position, in which the sweeper is opposed substantially parallel to the stacking plate in the bundling position;

the moving means being for holding the sheets stacked on the stacking plate between the sweeper and the stacking plate and for rotating the stacking plate from the stacking position to the bundling position;

curving means for curving the sheets, moved together with the stacking plate to the bundling position, the curving means including a first pressing portion provided on the sweeper, for pressing the central portion of the stacked sheets when the sweeper is rotated to the hold position, and a second pressing portion provided at the bundling position, for pressing the opposite side edge portions of the stacked sheets from the stacking plate side when the stacking plate is rotated to the bundling position by the sweeper; and bundling means for winding and bundling the sheets on the stacking plate, moved to the bundling position and curved, with the band.

19. A sheet bundling apparatus according to claim 18, which further comprises discharging means for discharging the sheets bundled with the band from over the stacking plate located at the bundling position in a direction included downward with respect to the horizontal direction after releasing the sheets from the curvature.

20. A sheet bundling apparatus according to claim 19, wherein the first pressing portion of the curving means has a first presser member for pressing the central portion of the stacked sheets, and a paid of second presser members situated on either side of the first presser member, the first presser member projecting closer to the stacked sheets than the second presser member; and the second pressing portion of the curving means includes a pair of presser lugs opposed to the second presser member of the sweeper in the hold position and individually pressing the opposite side edge portions of the stacked sheets from the stacking plate side.

* * * * *

UNITED STATES PATENT AND TRADEMARK OFFICE

CERTIFICATE OF CORRECTION

PATENT NO. : 5,735,108
DATED : April 7, 1998
INVENTOR(S) : Tuji

It is certified that error appears in the above-identified patent and that said Letters Patent is hereby corrected as shown below:

Please change: "[22] Filed: Oct. 22, 1996" to -- [22] Filed: Oct. 23, 1996 --

Signed and Sealed this

Second Day of October, 2001

*Attest:*

Nicholas P. Godici

NICHOLAS P. GODICI
*Acting Director of the United States Patent and Trademark Office*

*Attesting Officer*